US005944642A

United States Patent [19]

Krull

[11] Patent Number: 5,944,642

[45] **Date of Patent: *Aug. 31, 1999**

[54] METHODS AND APPARATUS FOR ADJUSTING RESISTANCE TO EXERCISE

[76] Inventor: Mark A. Krull, 1705 E. Ridge Ct., Northfield, Minn. 55057

[ * ] Notice: This patent is subject to a terminal disclaimer.

[21] Appl. No.: 09/192,857

[22] Filed: Nov. 16, 1998

Related U.S. Application Data

[63] Continuation-in-part of application No. 09/149,181, Sep. 8, 1998.

[51] Int. Cl.[6] ..... A63B 21/062

[52] U.S. Cl. ..... 482/98; 482/94; 482/99

[58] Field of Search ..... 482/93, 94, 97–103, 482/133, 136–138, 148, 908

[56] References Cited

U.S. PATENT DOCUMENTS 5,643,152 7/1997 Simonson ..... 482/98 X

FOREIGN PATENT DOCUMENTS 26 13 327 10/1980 France ..... 482/99

*Primary Examiner*—John Mulcahy

[57] ABSTRACT

Supplemental weights are disposed above a weight stack and are selectively movable into the path traversed by the top plate in the weight stack. The supplemental weights are maneuvered into and out of storage positions on the frame.

20 Claims, 20 Drawing Sheets

METHODS AND APPARATUS FOR ADJUSTING RESISTANCE TO EXERCISE

CROSS-REFERENCE TO RELATED APPLICATION

This application is a continuation-in-part of U.S. patent application Ser. No. 09/149,181, filed on Sep. 8, 1998.

FIELD OF THE INVENTION

The present invention relates to exercise equipment and more particularly, to exercise equipment that uses a variable number of weights to resist exercise motion.

BACKGROUND OF THE INVENTION

Exercise weight stacks are known in the art. Generally speaking, weights are arranged in a stack and movably mounted on guide rods. A selector rod is connected to a desired number of weights by means of a pin. The selector rod and any selected weights are connected to a force receiving member by means of a cable and move upward in response to exercise movement.

Although exercise weight stacks are prevalent in the exercise industry, they nonetheless suffer from certain shortcomings. For example, in order to provide a sufficiently large amount of weight at a reasonable cost, equipment manufacturers must use weights of relatively large mass. As a result, the weight being lifted cannot be adjusted in small increments.

Attempts have been made to address the issue of incremental adjustments. One such effort involves the provision of a second, adjacent weight stack comprising weights which weigh a fraction of the weights in the other or primary stack. A problem with this approach is that it adds significantly to the cost of the equipment. Another effort involves the provision of a half-weight, which weighs one-half the weight of each weight in the stack, and which is selectively movable from a peg on the frame onto an aligned peg on the top plate of the stack. This approach not only creates a balance problem during movement of the selected weights, but it also increases the potential for injury due to the proximity of the two pegs and their movement relative to one another.

Yet another prior art machine with supplemental weights is disclosed in French Patent No. 2,613,237 to Louvet. The Louvet machine includes a stack of primary weights movable along a guide rod in response to exercise movement, and a stack of secondary weights movable along the guide rod and selectively stored above the stack of primary weights. The secondary weights are supported by gates which are rotatably mounted on rigid frame members and axially supported by pegs on the gates and mating holes in the frame members. Each of nine secondary weights has a mass equal to one-tenth the mass of one of the primary weights.

One disadvantage of the Louvet machine is that nothing prevents a user from releasing a secondary weight without holding on to the weight being released. As a result, the secondary weight may be free to drop downward onto the top plate in the stack of primary weights, thereby increasing the likelihood of personal injury and/or damage to the machine. Also, each of the secondary weights is not separately supported by a respective gate. As a result, the entire stack of secondary weights may be released at one time, with or without a user holding onto to any of the secondary weights. Yet another shortcoming of the Louvet machine is that nine secondary weights are required to provide nine levels of incremental weight adjustments.

Another limitation with many existing weight stack machines, including the Louvet machine, is that the amount of resistance is uniform throughout the range of exercise motion, whereas the user's strength typically varies as a function of muscle contraction and extension. One response to this problem has been to use eccentric cam members to vary the amount of leverage being exerted against a fixed amount of weight. However, room for other solutions remains.

SUMMARY OF THE INVENTION

A preferred embodiment of the present invention provides an exercise apparatus with a primary weight stack and at least two supplemental weights disposed above the weight stack and selectively available for use together with the weight stack. The preferred embodiment includes a frame having first and second guide rods. A stack of weight plates, including a top plate, is mounted on the guide rods and movable between a lowermost position and an uppermost position. A first supplemental weight is mounted exclusively on the first guide rod and movable relative thereto between a first location, selectively supported above the uppermost position of the top plate, and a second location, inside a space defined between the uppermost position and the lowermost position. Similarly, a second supplemental weight is mounted exclusively on the second guide rod and movable relative thereto between a first location, selectively supported above the uppermost position of the top plate, and a second location, inside a space defined between the uppermost position and the lowermost position. For each of the supplemental weights, a user must physically maneuver the weight relative to the respective guide rod.

On the preferred embodiment, the second location of each supplemental weight is on top of the top plate in the stack. The top plate carries the mass of the supplemental weight(s) throughout its range of motion. On an alternative embodiment, the second location of each supplemental weight is above the top plate in the weight stack. In response to an exercise activity, the top plate moves upward a first distance before encountering the supplemental weight(s). With the mass of the supplemental weight(s) added to the mass of the top plate, the top plate continues to move upward a second distance in response to the exercise activity. On either of these embodiments, each supplemental weight may have a discrete amount of mass, thereby allowing the user to choose between the mass of the first weight, the mass of the second weight, and the combined mass of the two weights.

The present invention provides a variety of alternatives for positioning and/or selecting the supplemental weight(s). The various embodiments of the present invention store the supplemental weight(s) outside of harm's way yet prevent outright removal of the supplemental weight from the exercise equipment. Many of the features and advantages of the present invention will become apparent from the more detailed description that follows.

BRIEF DESCRIPTION OF THE FIGURES OF THE DRAWING

With reference to the Figures of the Drawing, wherein like numerals represent like parts and assemblies throughout the several views.

DETAILED DESCRIPTION OF A PREFERRED EMBODIMENT

The present invention provides methods and apparatus related to incremental adjustment of weight stack resistance. More specifically, an otherwise conventional weight stack machine is provided with supplemental weights which weigh a fraction of the weights in the stack and are selectively movable onto the top plate of the stack. The numbers and relative masses of the supplemental weights is a matter of design choice.

Figure 1:
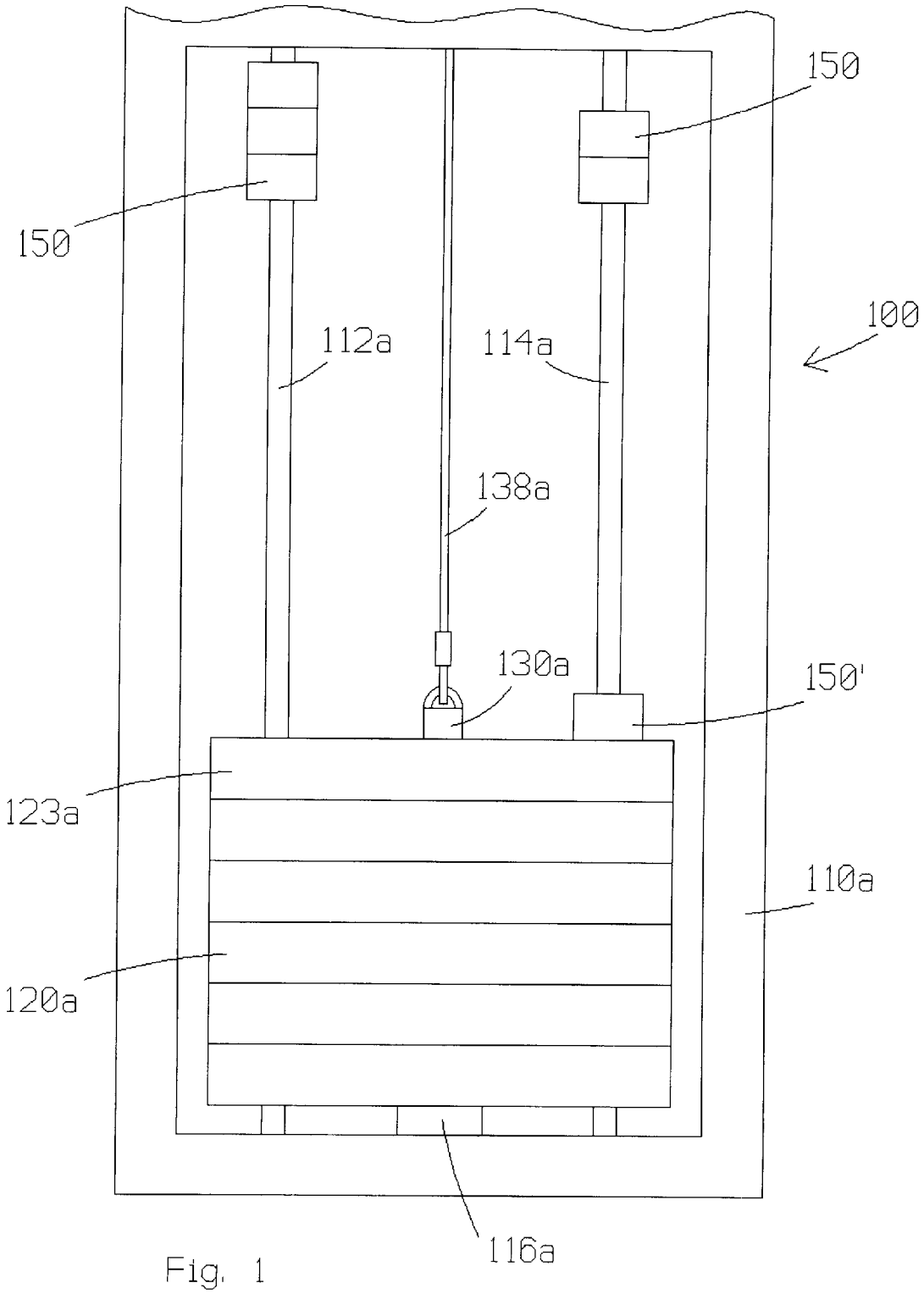
FIG. 1 is a partially fragmented, front view of a first exercise apparatus constructed according to the principles of the present invention.

FIG. 1 shows a first weight stack machine 100 which has been modified in accordance with the principles of the present invention. The machine 100 includes a frame 110*a* designed to rest upon a floor surface. First and second guide rods 112*a* and 114*a* extend vertically between lower and upper ends of the frame 110*a*. A top plate 123*a* and underlying weight plates 120*a* are movably mounted on the guide rods 112*a* and 114*a*. When not in use, the plates 123*a* and 120*a* rest against a shock absorbing member 116*a* on the lower end of the frame 110*a*.

A selector rod 130*a* extends through the plates 123*a* and 120*a* and is selectively connected to any desired plate 120*a* by a selector pin or other means known in the art. A cable 138*a* extends from an upper end of the selector rod 130*a* to one or more force receiving members which operate in a manner known in the art. As a result, movement of a force receiving member is resisted by gravity acting on the selected number of plates.

Figure 2:
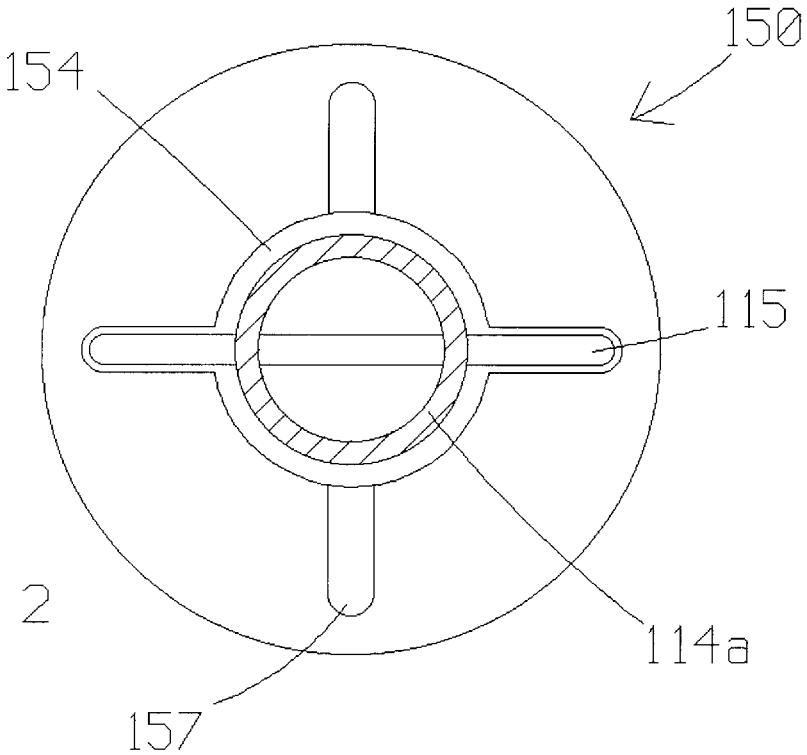
FIG. 2 is a partially sectioned, bottom view of a guide rod and supplemental weight on the exercise apparatus of FIG. 1.
Figure 3:
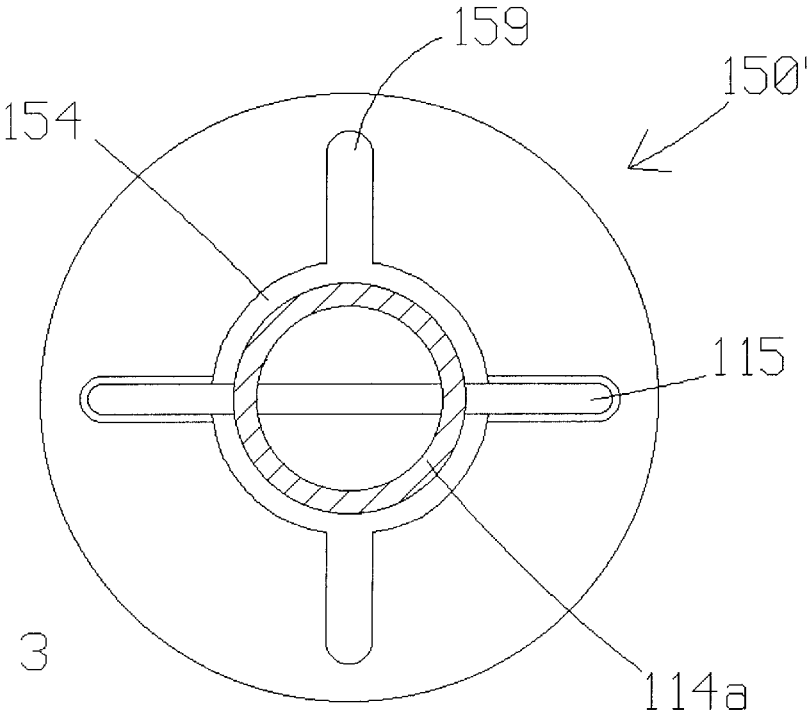
FIG. 3 is a partially sectioned, bottom view of the guide rod and supplemental weight of FIG. 2, the latter having been rotated ninety degrees relative to the former.

In accordance with the present invention, supplemental weights 150 and 150' are movably mounted on the guide rods 112*a* and 114*a* above the top plate 123*a*. As shown in FIGS. 2–3 (where the depicted guide rod 114*a* is representative of the other guide rod 112*a*), a pin 115 is rigidly secured to the guide rod 114*a* and extends perpendicular relative thereto.

A hole 154 is formed through each of the weights 150 and 150' to accommodate one of the guide rods 112*a* or 114*a*. A transverse notch 157 is formed in the bottom of each weight 150 or 150' to engage the pin 115 when the weight 150 or 150' is oriented as shown in FIG. 3. A transverse slot 159, which extends perpendicular to the notch 157, is formed through each weight 150 or 150' to provide clearance for the pin 115 when the weight 150 or 150' is oriented as shown in FIG. 2. The weight 150' shown in FIG. 1 was rotated ninety degrees relative to the weights 150 in order to descend the guide rod 114*a*. The top of each weight 150 or 150' may be provided with a ridge sized and configured to nest within the notch 157 and/or the slot 159 in an overlying weight 150. Such a ridge would cooperate with the notch 157 or the slot 159 to encourage simultaneous rotation of both the lower weight and the upper weight.

Those skilled in the art will recognize that the depicted embodiment 100 is capable of providing the same number and magnitude of resistance increments as the machine disclosed in French Patent No. 2,613,237, but with one-third fewer supplemental weights. In particular, if the three weights on the left-hand guide rod 112*a* include a one-half kilogram weight disposed between two one kilogram weights, and the three weights on the right-hand guide rod 114*a* includes a one kilogram weight disposed between two one-half kilogram weights, then various combinations of the six supplemental weights are available to provide weight adjustments between one-half kilogram and four and one-half kilograms, in increments of one-half kilogram (just like the nine supplemental weights on the Louvet machine).

Figure 4:
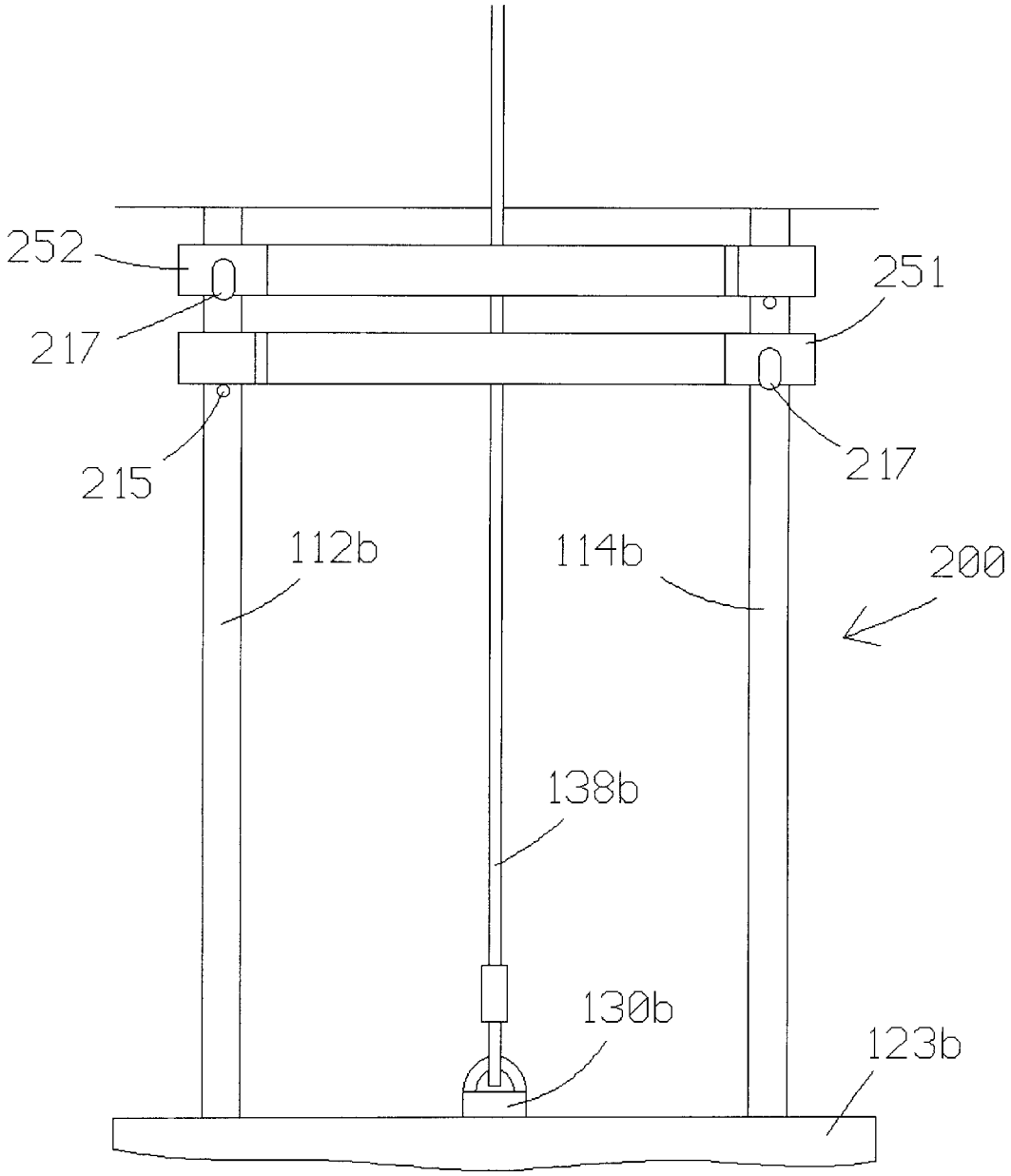
FIG. 4 is a partially fragmented, front view of a second exercise apparatus constructed according to the principles of the present invention.

FIG. 4 shows a second weight stack machine 200 which has been modified in accordance with the principles of the present invention. The machine 200 similarly includes a weight stack, including top plate 123*b*, movably mounted on guide rods 112*b* and 114*b*. A selector rod 130*b* extends through the weight stack and is connected to a force receiving member by means of cable 138*b*.

Supplemental weights 251 and 252 are movably mounted on the guide rods 112*b* and 114*b* above the top plate 123*b*.

Figure 5:
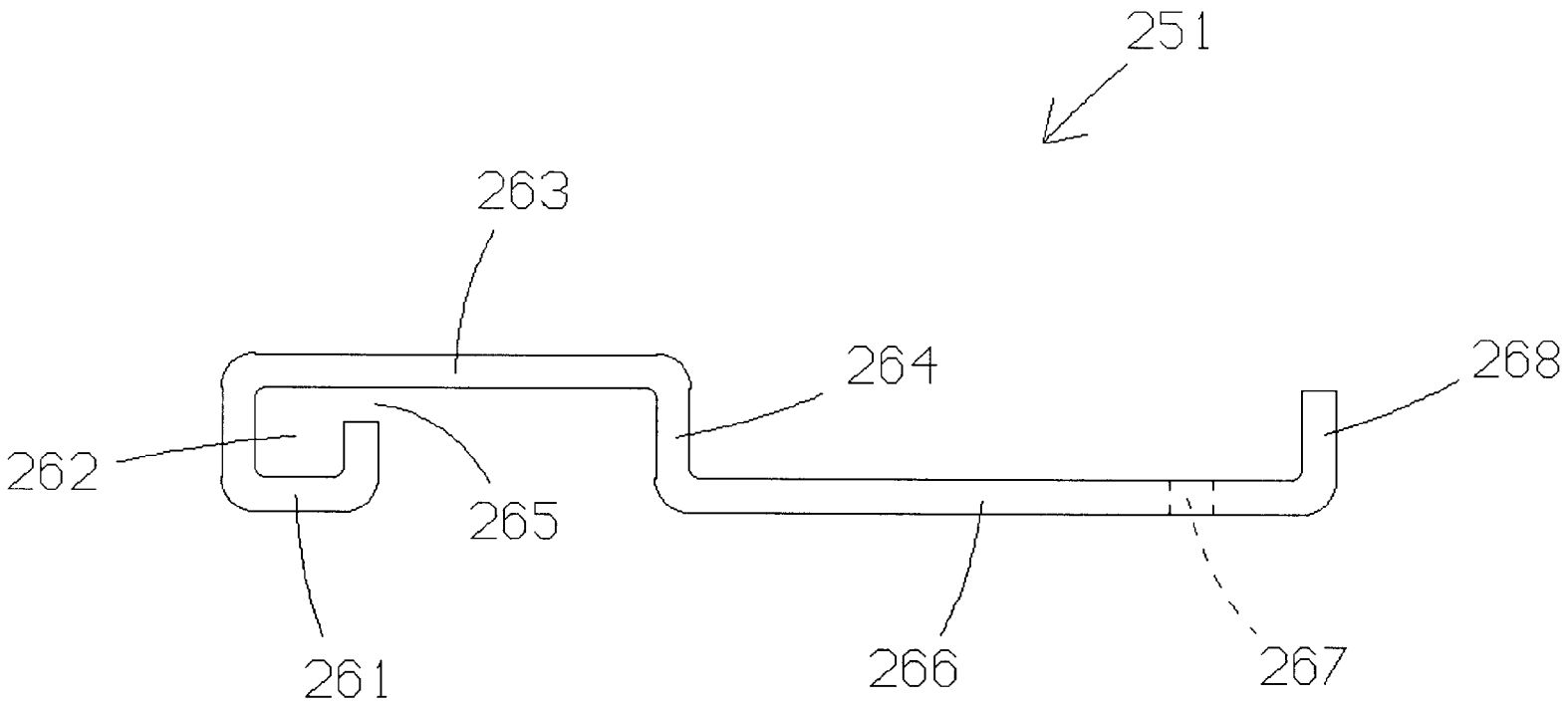
FIG. 5 is a top view of a supplemental weight on the exercise apparatus of FIG. 4.

As shown in FIG. 5 (where the depicted weight 251 is a mirror image of the other weight 252), the weight 251 is a bar that has been bent or otherwise formed to interact with the guide rods 112*b* and 114*b* while avoiding the selector rod 130*b* and/or the cable 138*b*.

A first end 261 of the bar 251 forms a substantially closed loop which is interrupted by a slot 265 disposed between the end 261 and an intermediate segment 263. The loop bounds an opening 262 sufficient in size to accommodate the guide rod 112*b*. A central segment 264 of the bar 251 is interconnected transversely between the intermediate segment 263 and an opposite intermediate segment 266. The segments 263 and 266 are different lengths to space the segment 264 apart from the selector rod 130*b* and cable 138*b*. A notch 267 is formed in the underside of the segment 266, near the second, opposite end 268, for reasons explained below.

When the weight 251 is arranged as shown in FIG. 4, the first end 261 rests upon a transversely extending pin 215 rigidly secured to the guide rod 112*b*, and the segment 266 rests upon a transversely extending hook 217 rigidly secured to the guide rod 114*b*. The hook 217 has a transversely extending shaft which nests inside the notch 267, and an upwardly extending end which discourages rotation of the weight 251 about the guide rod 112*b*. The weight 251 is lowered onto the top plate 123*b* by lifting the weight 251 off the hook 217 and rotating the weight 251 until the slot 265 aligns with the pin 215. An advantage of this embodiment (and certain other embodiments described herein) is that the mass of each of the weights 251 and 252 is relatively evenly distributed across the top plate 123*b*.

Figure 6:
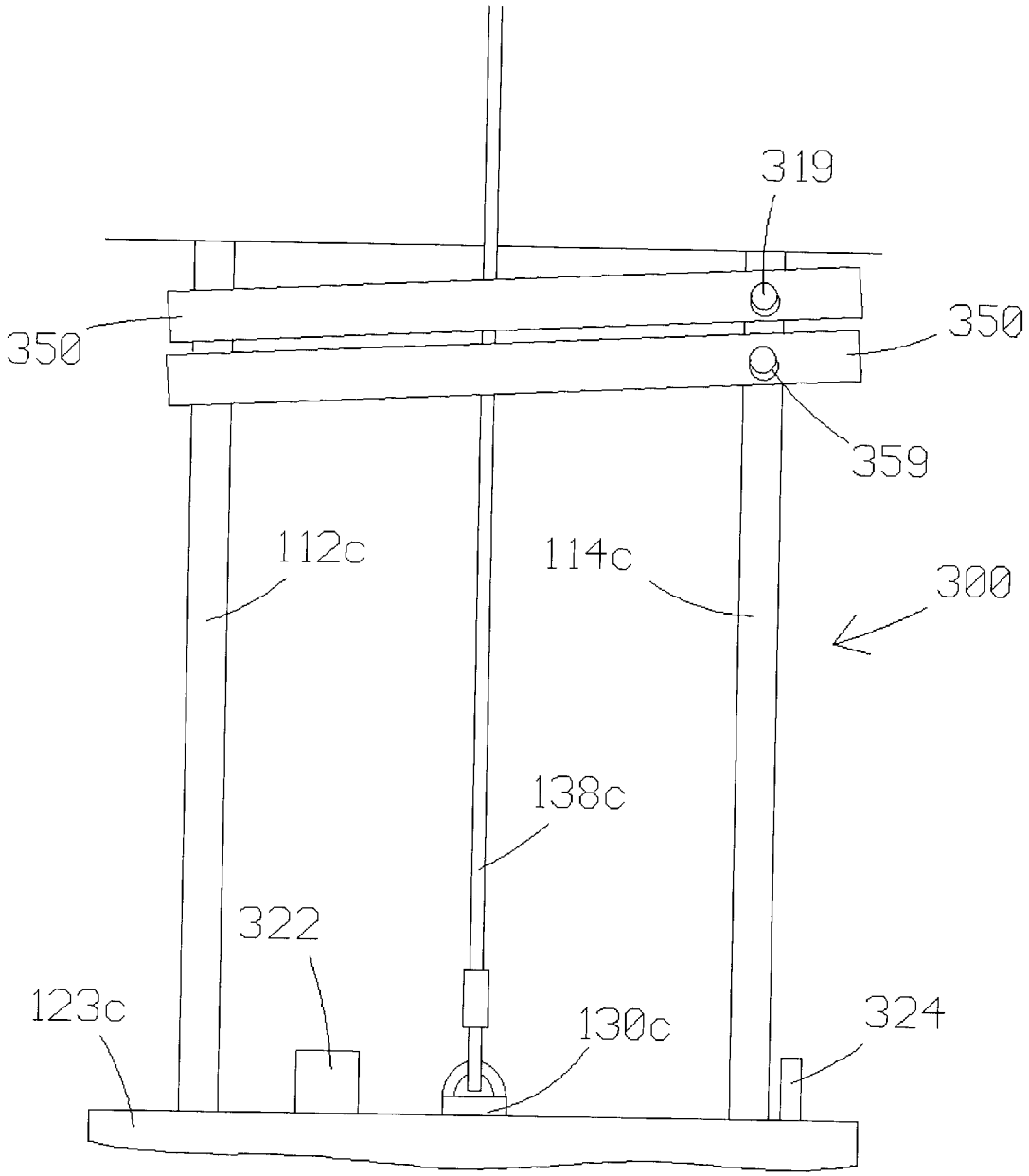
FIG. 6 is a partially fragmented, front view of a third exercise apparatus constructed according to the principles of the present invention.

FIG. 6 shows a third weight stack machine 300 which has been modified in accordance with the principles of the present invention. The machine 300 similarly includes a weight stack, including top plate 123*c*, movably mounted on guide rods 112*c* and 114*c*. A selector rod 130*c* extends through the weight stack and is connected to a force receiving member by means of cable 138*c*.

Figure 7:
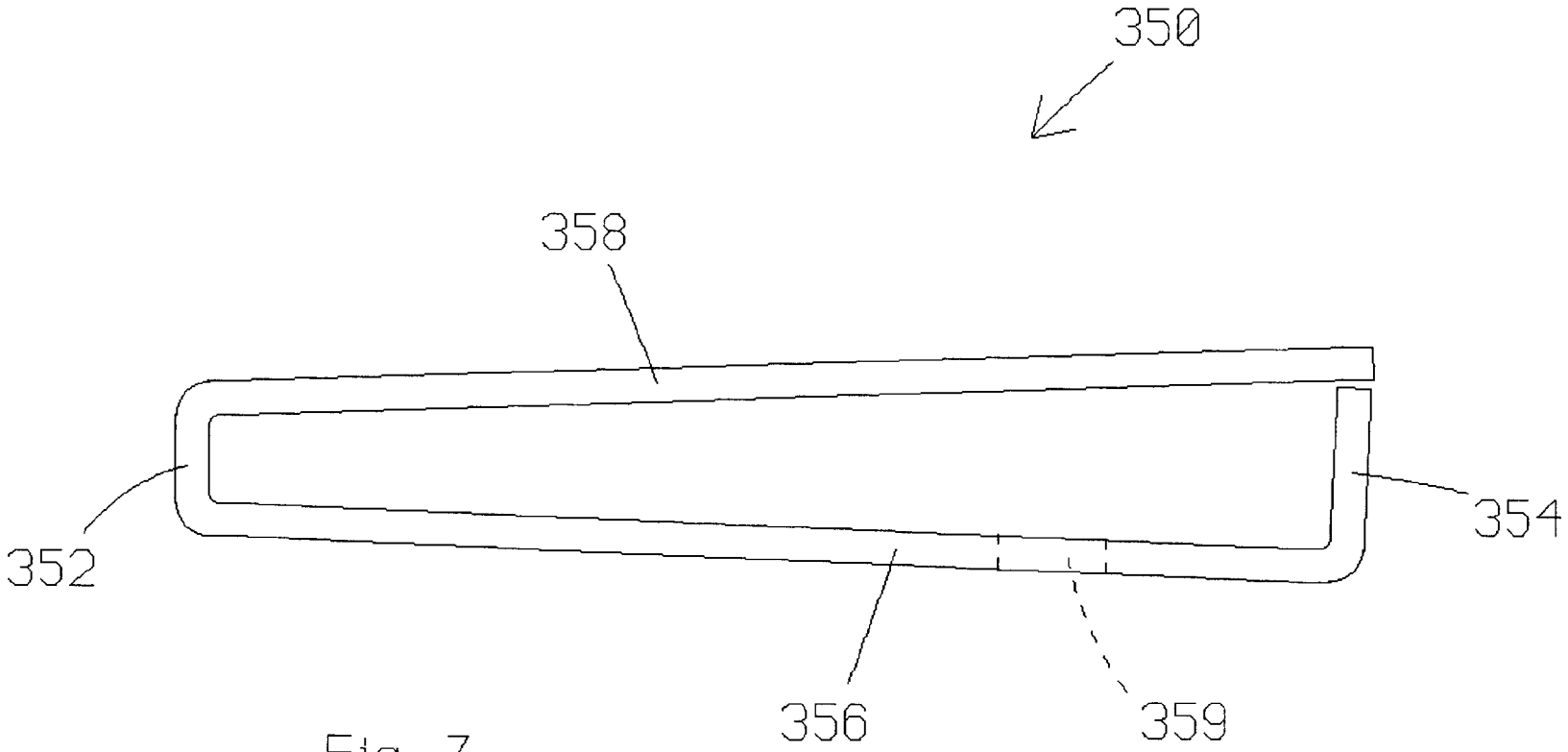
FIG. 7 is a top view of a supplemental weight on the exercise apparatus of FIG. 6.

Supplemental weights 350 are movably mounted on the guide rods 112*c* and 114*c* above the top plate 123*c*. As shown in FIG. 7, each weight 350 is a bar that has been bent or otherwise formed to interact with the guide rods 112*c* and 114*c* and not interfere with the selector rod 130*c* and/or the cable 138*c*.

Each bar 350 may be described as a substantially closed loop having relatively short ends 352 and 354 and relatively long sides 356 and 358. Each loop is sized and configured to fit around both guide rods 112*c* and 114*c*. A hole 359 is formed in the front side 356 of the bar 350, proximate the relatively longer end 354, for reasons explained below.

When the weight 350 is arranged as shown in FIG. 6, the second end 354 is supported by a transversely extending bolt 319 rigidly secured to the guide rod 114*c*, and the first end 352 rests against the guide rod 112*c*. The bolt 319 has a shaft which extends through the hole 359, and a larger diameter head which discourages rotation of the weight 350 about the guide rod 112*c*. The weight 350 is lowered onto the top plate 123*c* by lifting the weight 350 off the bolt 319 and rotating the weight 350 until the front side 356 clears the head of the bolt 319.

Supports 322 and 324 are provided on the top plate 123*c* to stabilize the weights 350 during exercise. The support 322 has a trapezoidal shape which engages the sides 356 and 358 to discourage movement of the end 352 toward the guide rod 114*c*, and the support 324 has a rectangular shape which engages the end 354 to discourage movement of the end 354 toward the guide rod 112*c*.

Figure 8:
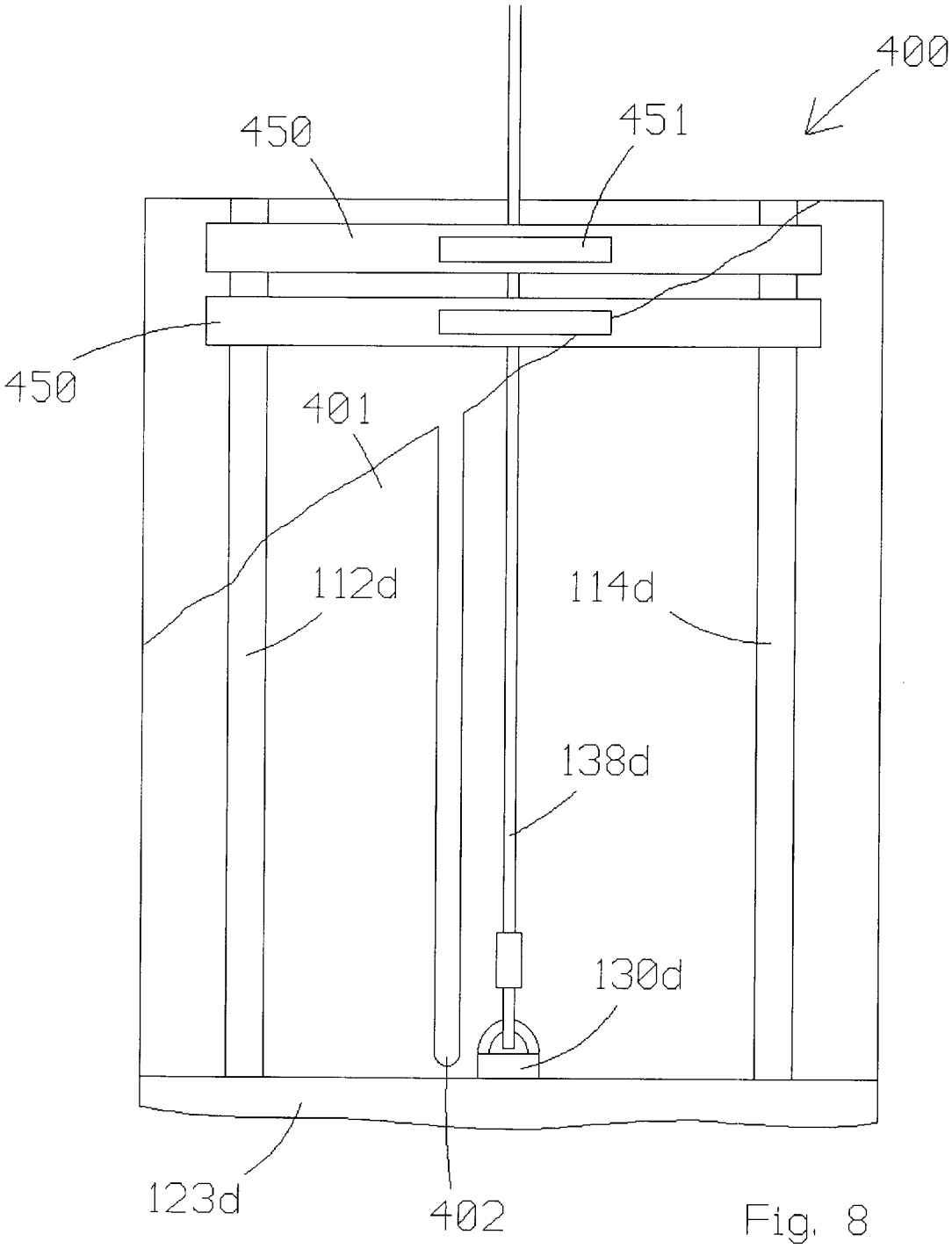
FIG. 8 is a partially fragmented, front view of a fourth exercise apparatus constructed according to the principles of the present invention.

FIG. 8 shows a fourth weight stack machine 400 which has been modified in accordance with the principles of the present invention. The machine 400 similarly includes a weight stack, including top plate 123*d*, movably mounted on guide rods 112*d* and 114*d*. A selector rod 130*d* extends through the weight stack and is connected to a force receiving member by means of cable 138*d*.

Figure 9:
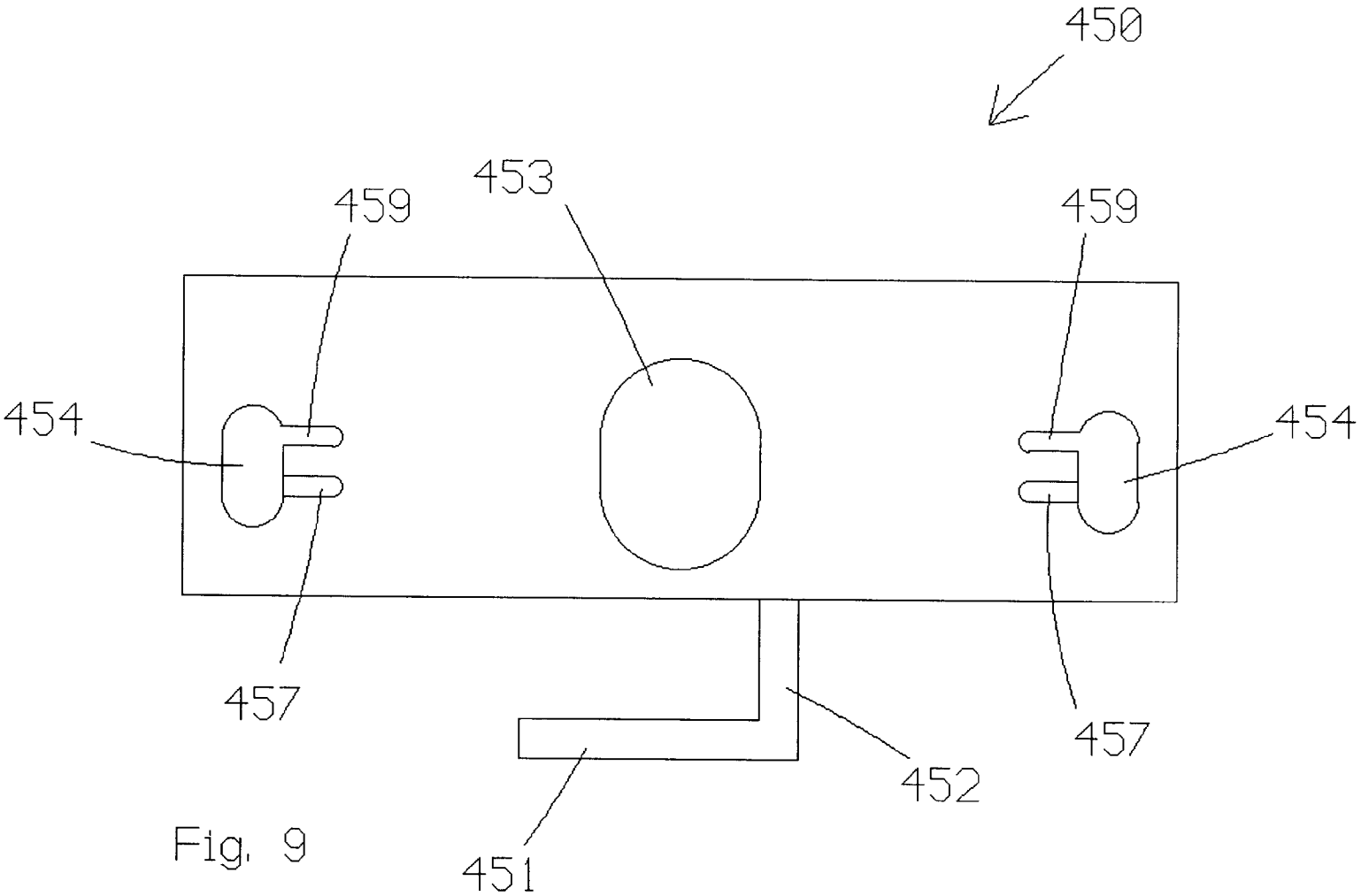
FIG. 9 is a bottom view of a supplemental weight on the exercise apparatus of FIG. 8.

Supplemental weights 450 are movably mounted on the guide rods 112*d* and 114*d* above the top plate 123*d*. Also, a safety shield 401 is provided to substantially cover or enclose the moving parts of the apparatus 400. A slot 402 is provided in the shield 401 to facilitate manipulation of the supplemental weights 450. As shown in FIG. 9, a shaft 452 is sized and configured to extend through the slot 402 and connect a respective weight 450 to a respective handle 451 disposed on the near side of the shield 401.

A central hole 453 is formed through the weight 450 to provide clearance for the cable 138*d*. Smaller oval holes 454 are formed through the weight 450 to accommodate the guide rods 112*d* and 114*d*. Pins (not shown) extend transversely from respective guide rods 112*d* and 114*d* and toward one another. Transverse notches 457 are formed in the bottom of the weight 450 to engage the pins when the weight 450 occupies a first position relative to the guide rods 112*d* and 114*d*. Transverse slots 459 are formed through the weight 450 to accommodate the pins when the weight 450 occupies a second, transversely displaced position relative to the guide rods 112*d* and 114*d*.

Each weight 450 is lowered onto the top plate 123*d* by pulling the handle 451 toward the reader and allowing the weight 450 to descend. The shield 401 may be made to cooperate with the shaft 452 in a manner which controls descent of the weight 450 but does not interfere with ascent of the weight 450. Also, the weights 450 (as well as the weights on other embodiments) may be coated with a shock absorbing material or otherwise modified to reduce impact and/or noise during operation.

Figure 10:
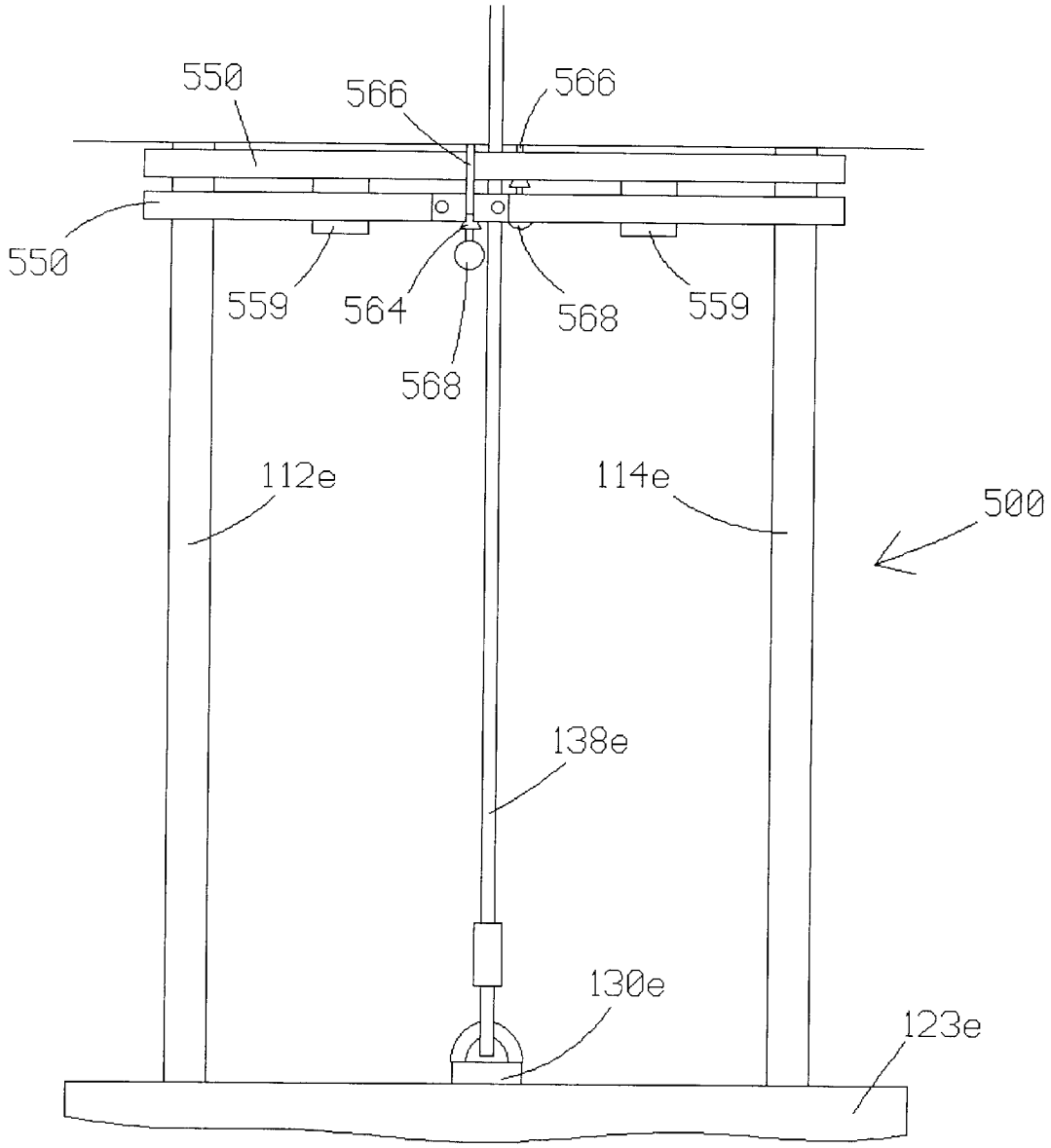
FIG. 10 is a partially fragmented, front view of a fifth exercise apparatus constructed according to the principles of the present invention.

FIG. 10 shows a fifth weight stack machine 500 which has been modified in accordance with the principles of the present invention. The machine 500 similarly includes a weight stack, including top plate 123*e*, movably mounted on guide rods 112*e* and 114*e*. A selector rod 130*e* extends through the weight stack and is connected to a force receiving member by means of cable 138*e*.

Figure 11:
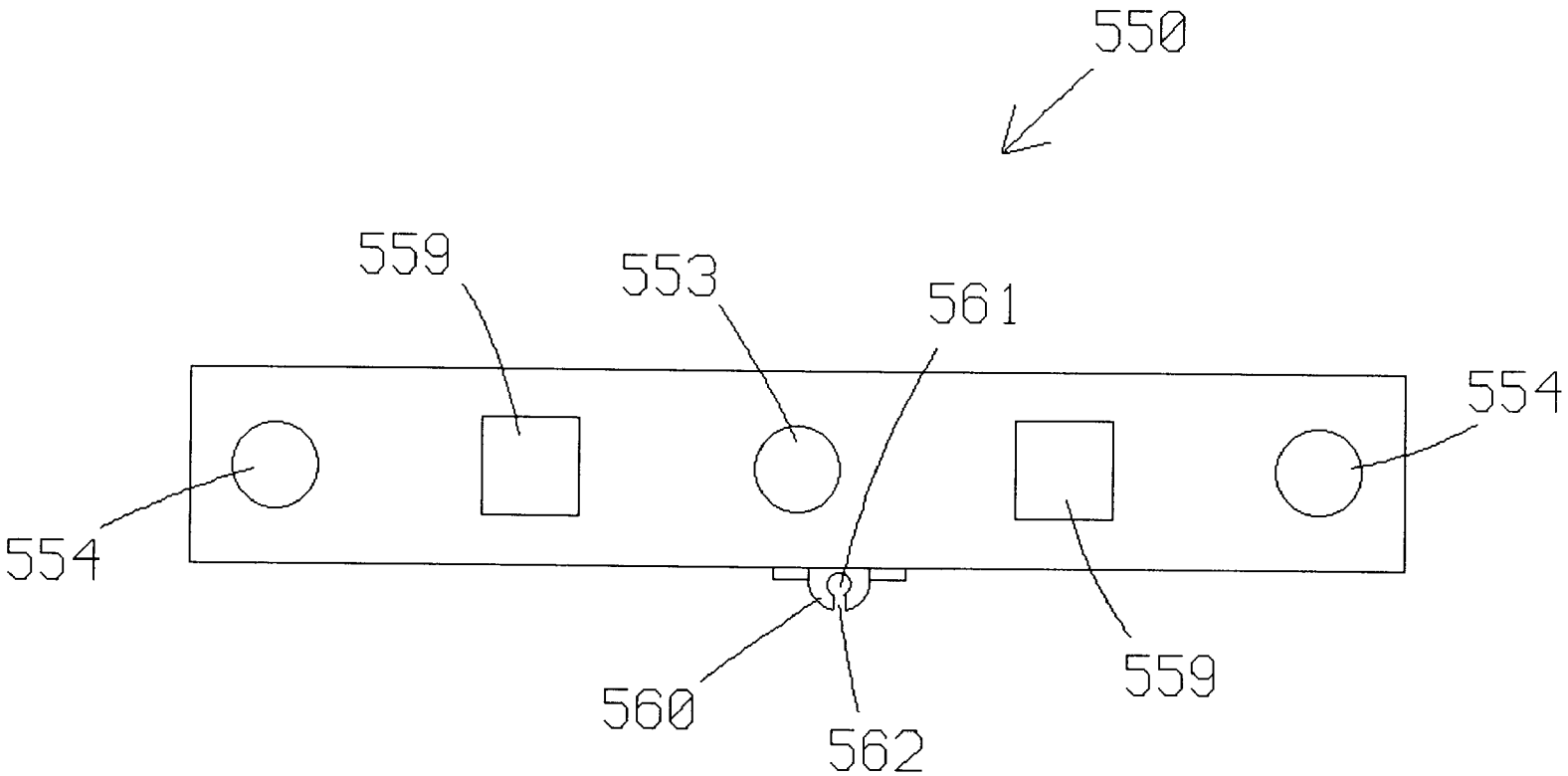
FIG. 11 is a bottom view of a supplemental weight on the exercise apparatus of FIG. 10.

Supplemental weights 550 are movably mounted on the guide rods 112*e* and 114*e* above the top plate 123*e*. As shown in FIG. 11, each weight 550 is a plate provided with a central hole 553 to accommodate the selector rod 130*e* and the cable 138*e*, and with opposite end holes 554 to accommodate the guide rods 112*e* and 114*e*. As suggested above, rubber pads 559 are mounted on the bottom of each of these weights 550 to provide a buffer between the weight 550 and the top plate 123*e*.

A bracket 560 is mounted on the front side of the lower weight 550 (by bolts, for example). The bracket 560 provides an upwardly concave or tapered opening 561 which is accessible via a vertical slot 562. A stop 564 having a conical shape is connected to the frame of the apparatus 500 by means of a flexible cord 566. A handle or ball 568 is connected to a distal end of the cord 566 to facilitate manipulation thereof. The cord 566 is sized and configured to pass through the slot 562, and the stop 564 is sized and configured to occupy the opening 561. The lower weight 550 is lowered onto the top plate 123*e* by pushing the weight 550 upward, pulling the respective cord 566 (toward the reader), and allowing the weight 550 to descend. The upper weight 550 is disengaged from the frame by moving the respective cord 566 away from the reader.

Figure 12:
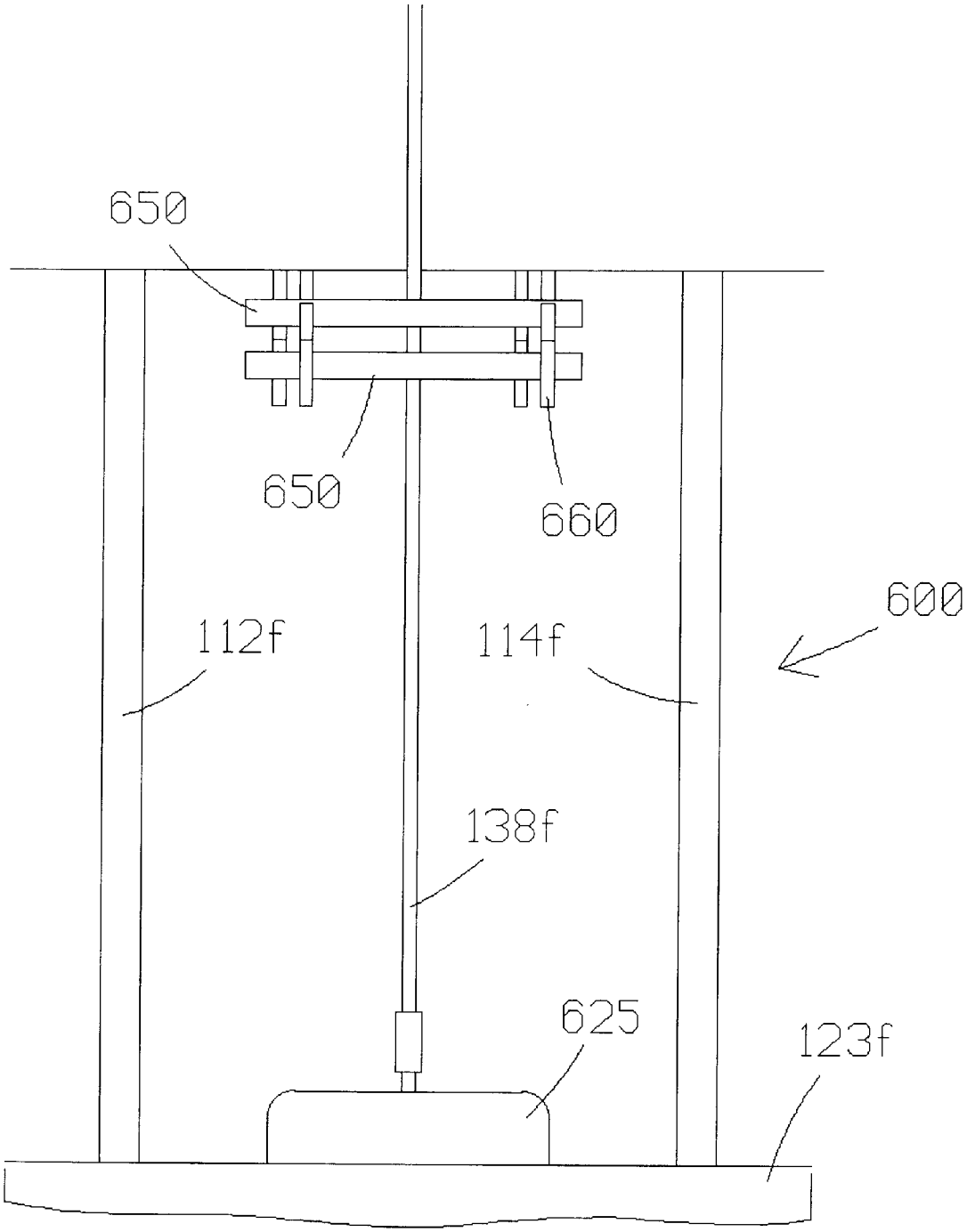
FIG. 12 is a partially fragmented, front view of a sixth exercise apparatus constructed according to the principles of the present invention.

FIG. 12 shows a sixth weight stack machine 600 which has been modified in accordance with the principles of the present invention. The machine 600 similarly includes a weight stack, including top plate 123*f*, movably mounted on guide rods 112*f* and 114*f*. A selector rod extends through the weight stack and is connected to a force receiving member by means of cable 138*f*.

Supplemental weights 650 are selectively movable onto the top plate 123*f* along a path dictated by cable 138*f*. Each weight 650 forms a substantially closed loop about the cable 138*f*, while the guide rods 112*f* and 114*f* are disposed outside the loop. When lowered onto the top plate 123*f*, each weight 550 fits snugly about a block 625 on the top plate 123*f*. As suggested elsewhere in this description, the block 625 is only one of several positioning devices suitable for use on this embodiment 600 and/or the other embodiments disclosed herein.

Figure 13:
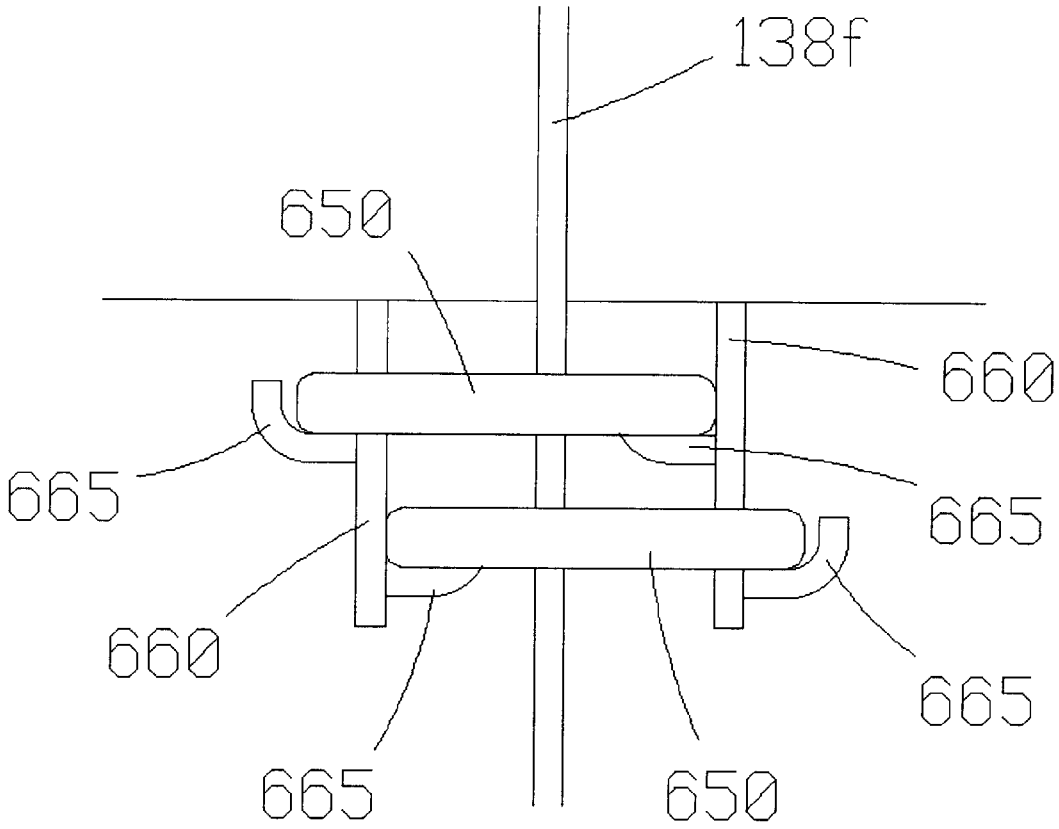
FIG. 13 is a side view of supports and supplemental weights on the exercise apparatus of FIG. 12.

Supports 660 are secured to the frame of the apparatus 600 and extend downward toward the top plate 123*f*. As shown in FIG. 13, the supports 660 provide hooks 665 to selectively retain the weights 650. The lower weight 650 is lowered onto the top plate 123*f* by first moving it upward and away from the reader and then moving it downward when free of the hooks 665. An advantage of this embodiment (and certain other embodiments described herein) is that the weights 650 do not engage the guide rods 112*f* and 114*f*, but are still connected to the apparatus 600.

Figure 14:
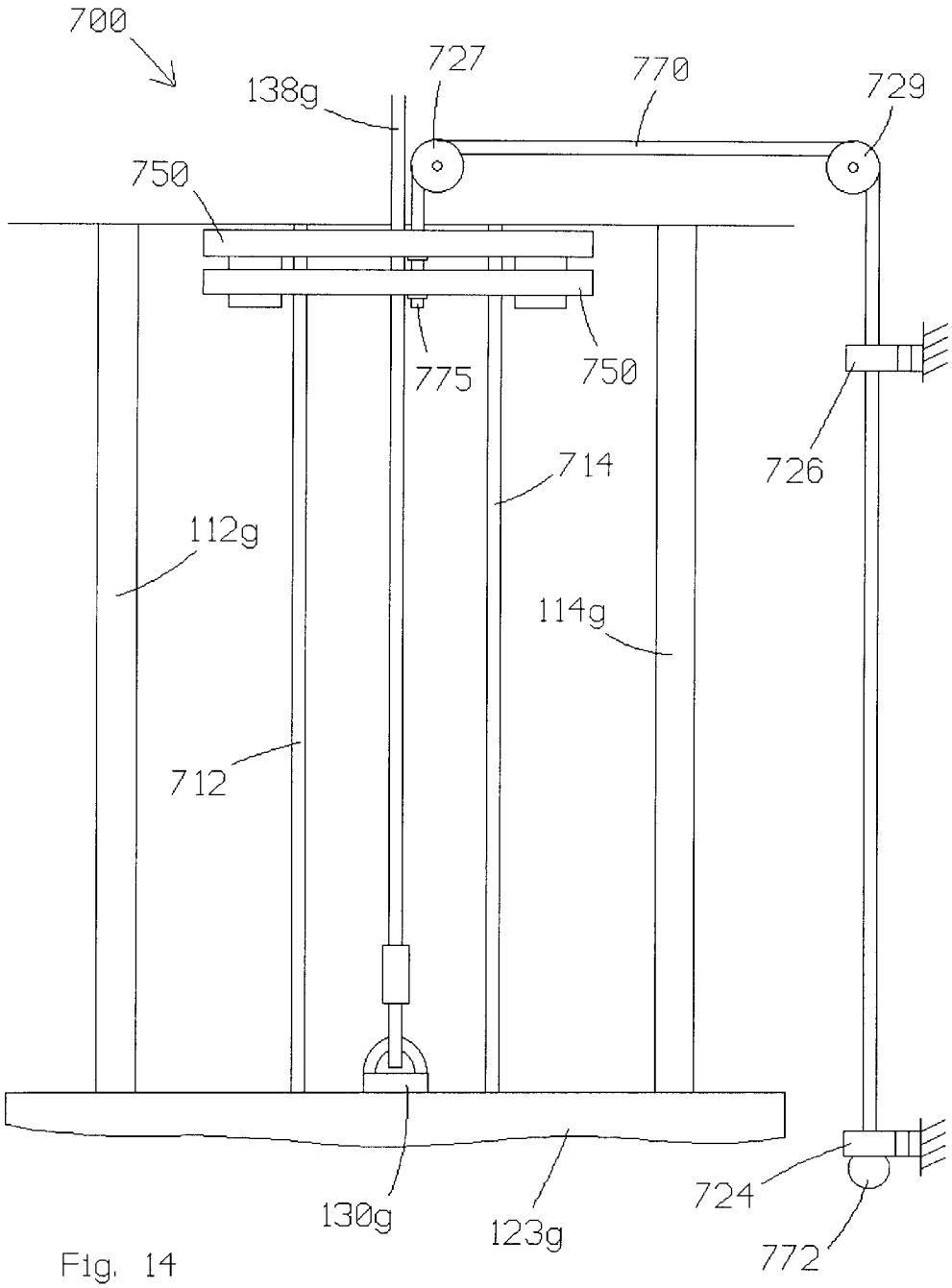
FIG. 14 is a partially fragmented, front view of a seventh exercise apparatus constructed according to the principles of the present invention.

FIG. 14 shows a seventh weight stack machine 700 which has been modified in accordance with the principles of the present invention. The machine 700 similarly includes a weight stack, including top plate 123*g*, movably mounted on guide rods 112*g* and 114*g*. A selector rod 130*g* extends through the weight stack and is connected to a force receiving member by means of cable 138*g*.

Supplemental weights 750 are selectively movable onto the top plate 123*g* along a path dictated by guide cords 712 and 714, which extend between the frame and the top plate 123*g* (independent of the guide rods 112*g* and 114*g*). In the alternative, the lower ends of the guide cords could be secured to a lower portion of the frame. In either case, each of the weights 750 is a plate having a central hole 753 to provide clearance for the cable 138*g* and the selector rod 130*g*. Diametrically opposed holes 756 are formed through the weight 750 to accommodate respective guide cords 712 and 714. Hole 751 is formed through the upper weight 750 to facilitate attachment of the upper weight 750 to a first support 770, and hole 752 is formed through the upper weight 750 to provide clearance for a second support 770 that is attached to the lower weight 750. Resilient bumpers 759 are mounted on the side of each weight 750 nearest the top plate 123*g*.

The supports 770 are connected to the frame of the apparatus 700 by pulleys 727 and 729 and brackets 724 and 726. A first end of one support 770 is threaded through the holes 752 in the weights 750 and secured to the lower weight 750 by a fastener 775. A first end of the other support 770 is threaded through the hole 751 in the upper weight 750 and secured thereto by another fastener 775. An opposite end of each support 770 is connected to a respective ball or handle 772 which is moved from the bracket 724 to the bracket 726 in order to lower a respective weight 750. An advantage of this embodiment is that the weights 750 may be lowered remotely. Moreover, the manually operated adjustment mechanism could be replaced by a motorized winch, for example, to facilitate automated weight adjustment.

Figure 16:
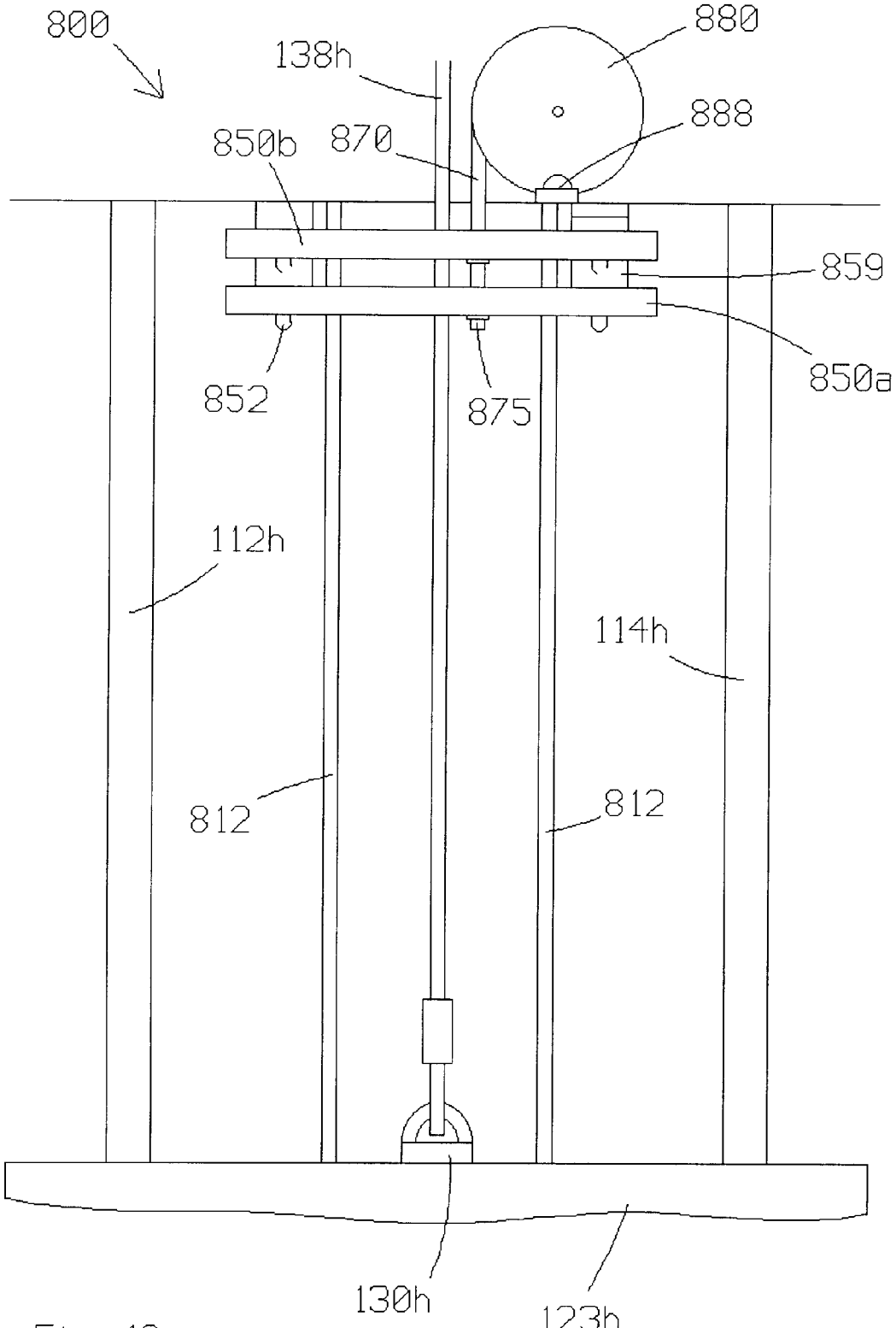
FIG. 16 is a partially fragmented, front view of an eighth exercise apparatus constructed according to the principles of the present invention.

FIG. 16 shows an eighth weight stack machine 800 which has been modified in accordance with the principles of the present invention. The machine 800 similarly includes a weight stack, including top plate 123*h*, movably mounted on guide rods 112*h* and 114*h*. A selector rod 130*h* extends through the weight stack and is connected to a force receiving member by means of cable 138*h*.

Figure 15:
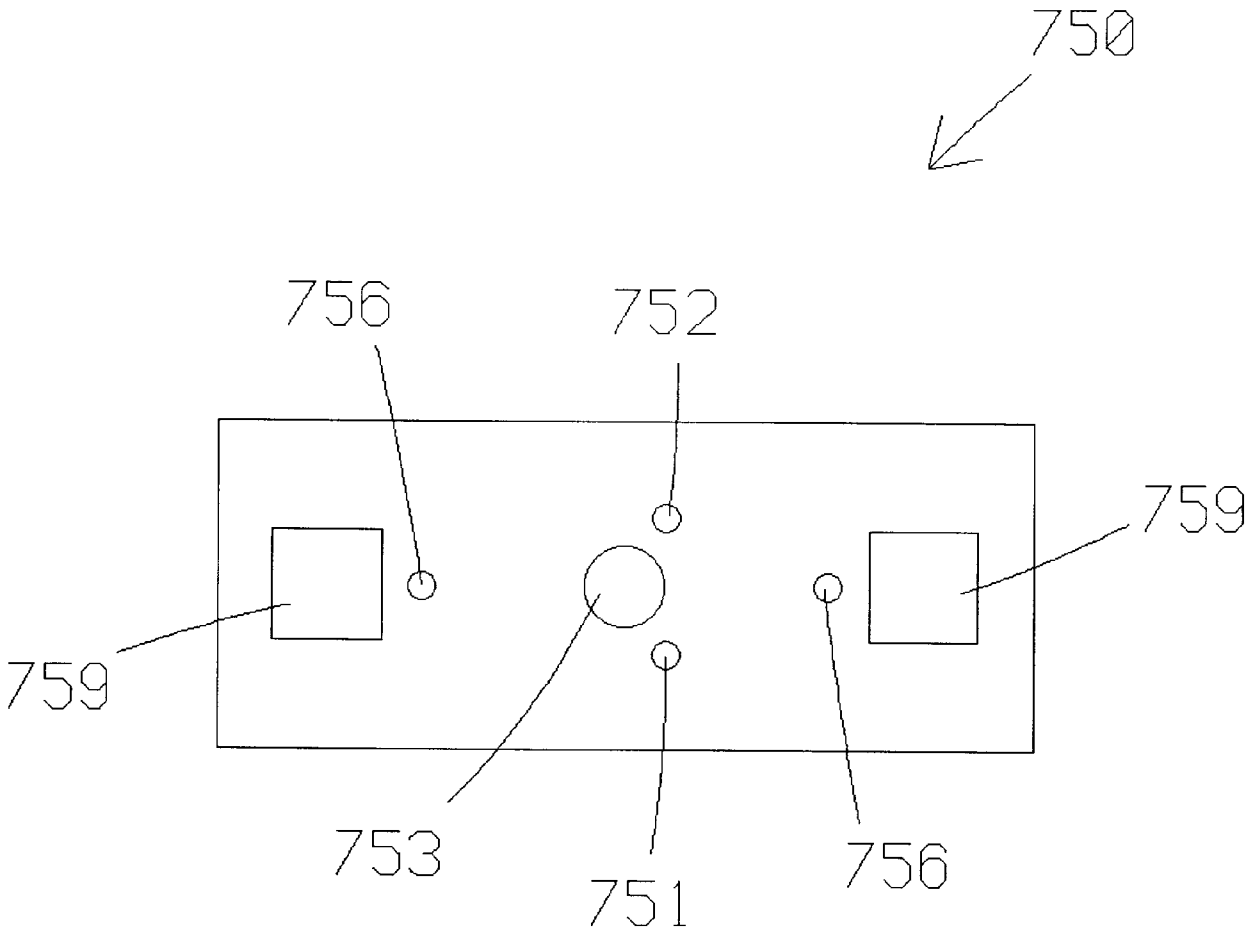
FIG. 15 is a bottom view of a supplemental weight on the exercise apparatus of FIG. 14.

Supplemental weights 850*a* and 850*b* are selectively movable onto the top plate 123*h* along a path dictated by guide cords 812 and 814, which extend between the top plate 123*h* and an upper portion of the frame. The weights 850*a* and 850*b* are similar to the weights 750 shown in FIG. 15, except that (a) relatively larger spacers 859 are disposed on a top side of each weight 850*a* or 850*b*; (b) pegs 852 extend downward from the weight 850*a* to selectively engage holes extending downward into the top plate 123*h*; and (c) holes extend downward into the weight 850*a* (or the spacers 859 on the weight 850*a*) to selectively receive pegs extending downward from the weight 850*b*.

For each of the weights 850*a* and 850*b*, a flexible cord 870 extends between the weight 850*a* or 850*b* and a respective spring-biased reel 880. A first end of each cord 870 is connected to a respective reel 880, and a second, opposite end of each cord 870 is connected to a respective weight 850*a* or 850*b* by means of a fastener 875. The spring force of the reel 880 is sufficiently strong to maintain the weight 850*a* or 850*b* in the raised position. The weight 850*a*, for example, is moved to the lowered position simply by pulling downward, as a latching mechanism 888 (such as a pivoting pawl, for example) releasably locks the reel 880 against rewinding. The latching mechanism 888 may be subsequently released to return the weight 850*a* upward.

An advantage of this embodiment is that the weights 850*a* and 850*b* are not prone to fall toward the top plate 123*h* and possibly cause bodily injury or damage to the machine 800. Those skilled in the art will recognize that a variety of other known counterbalances may substituted for the spring-biased reels 880.

Figure 17:
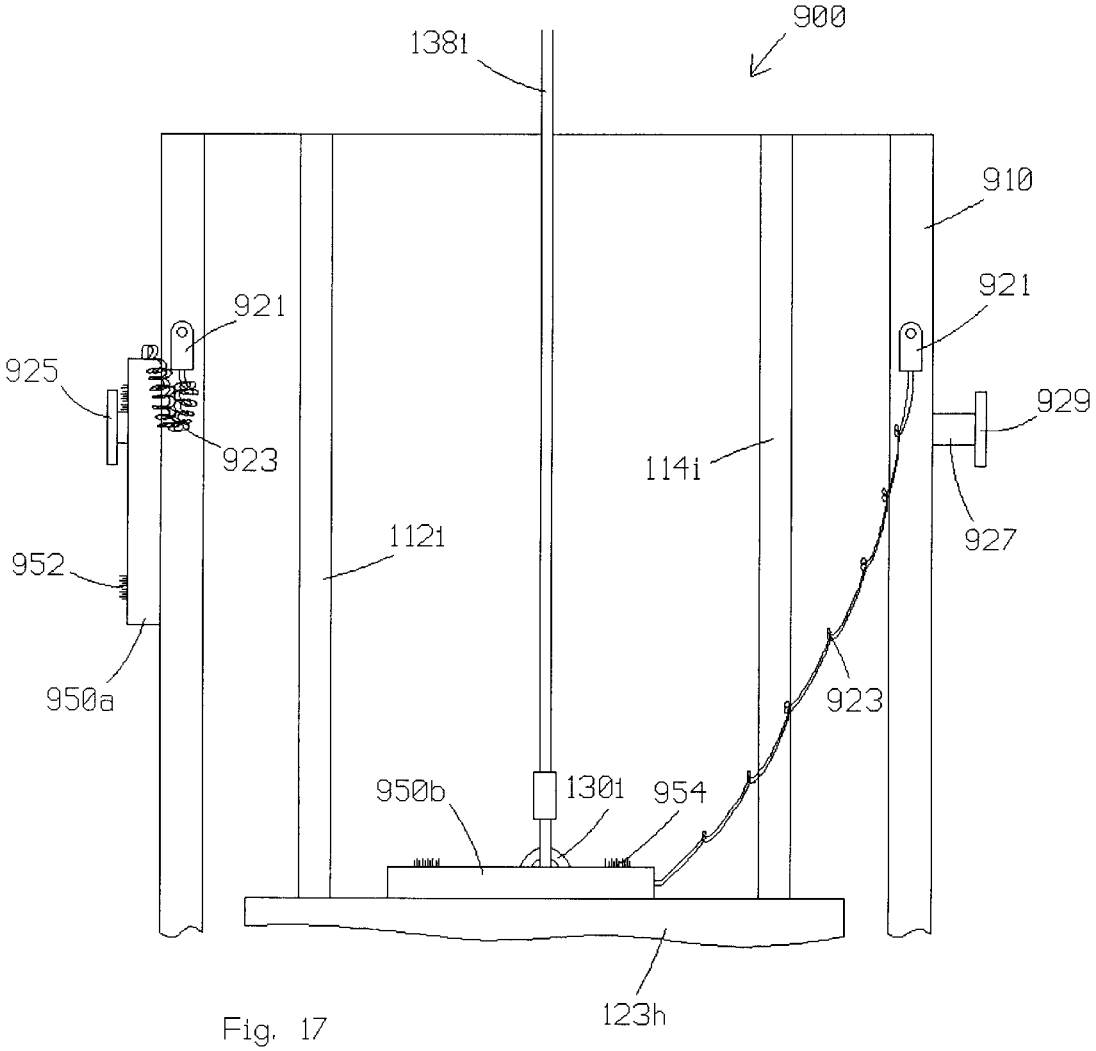
FIG. 17 is a partially fragmented, front view of a ninth exercise apparatus constructed according to the principles of the present invention.

FIG. 17 shows a ninth weight stack machine 900 which has been modified in accordance with the principles of the present invention. The machine 900 similarly includes a weight stack, including top plate 123*i*, movably mounted on guide rods 112*i* and 114*i*. A selector rod 130*i* extends through the weight stack and is connected to a force receiving member by means of cable 138*i*.

Figure 18:
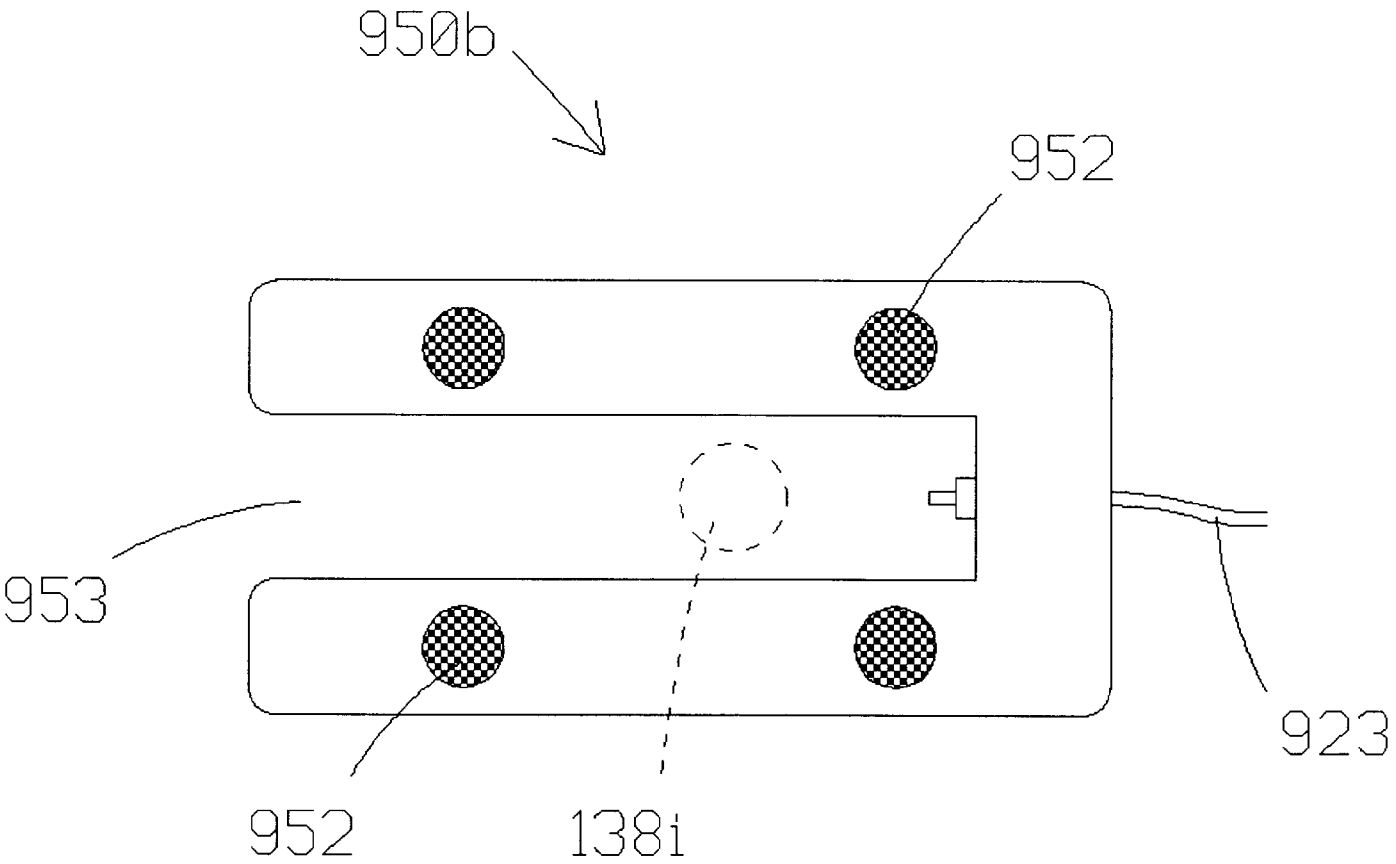
FIG. 18 is a bottom view of a supplemental weight on the exercise apparatus of FIG. 17.

Supplemental weights 950*a* and 950*b* are selectively movable onto the top plate 123*i* along a path limited by respective tethers 923, which extend between the frame 910 and respective weights 950*a* and 950*b*. As shown in FIG. 18, the weight 950*b* (which is representative of the weight 950*a*) is U-shaped to occupy a balanced position relative to the top plate 123*i*, and to provide clearance for the selector rod 138*i* inside slot 953. Hook type fasteners 952 are mounted on one side of the weight 950*b* to mate with loop type fasteners on the top plate 123*i*. Loop type fasteners 954 are mounted on an opposite side of the weight 950*b* to mate with hook type fasteners on the other plate 950*a* (which also has loop type fasteners on an opposite side, in case the two weights 950*a* and 950*b* are reversed).

The tethers 923 are similar to telephone cords which form a helical coil when free of tension. A first end of each tether 923 is secured to a respective weight 950*a* or 950*b*, and a second, opposite end of each tether 923 is secured to a respective bracket 921 pivotally mounted to the frame 910. Weight supports 925 are secured to the frame 910 to retain the weights 950*a* and 950*b* when not in use. Each support 925 includes a square shaft 927 which fits into the slot 953 in either weight 950*a* or 950*b*, and a flange 929 which spans a portion of either weight 950*a* or 950*b*. Other suitable supports may be used to retain the weights 950*a* and 950*b* on the frame directly above the top plate 123*i*.

Figure 19:
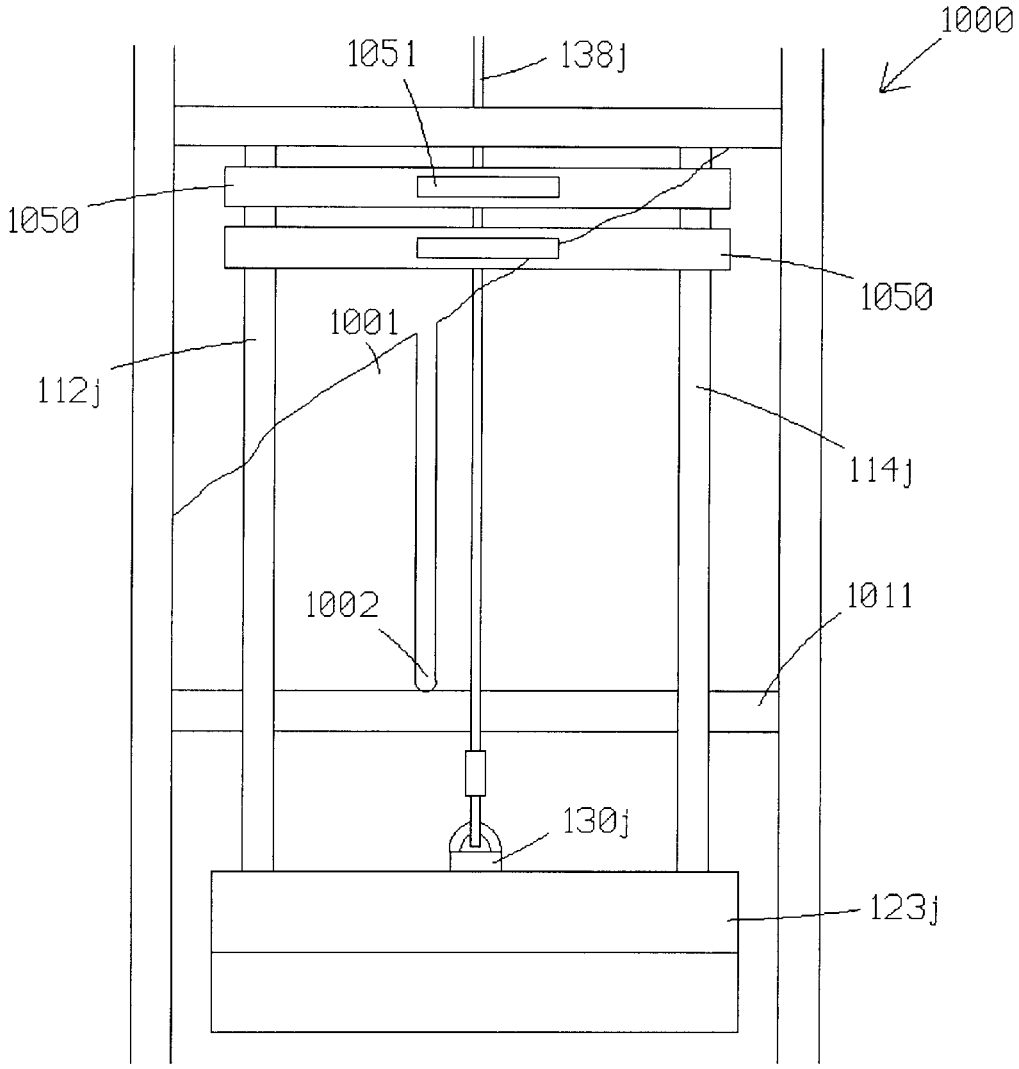
FIG. 19 is a partially fragmented, front view of a tenth exercise apparatus constructed according to the principles of the present invention.

FIG. 19 shows a tenth weight stack machine 1000 which has been modified in accordance with the principles of the present invention, and which is similar in many respects to the machine 400 shown in FIG. 8. The machine 100 similarly includes a weight stack, including top plate 123*j*, movably mounted on guide rods 112*j* and 114*j*. A selector rod 130*j* extends through the weight stack and is connected to a force receiving member by means of cable 138*j*.

Figure 20:
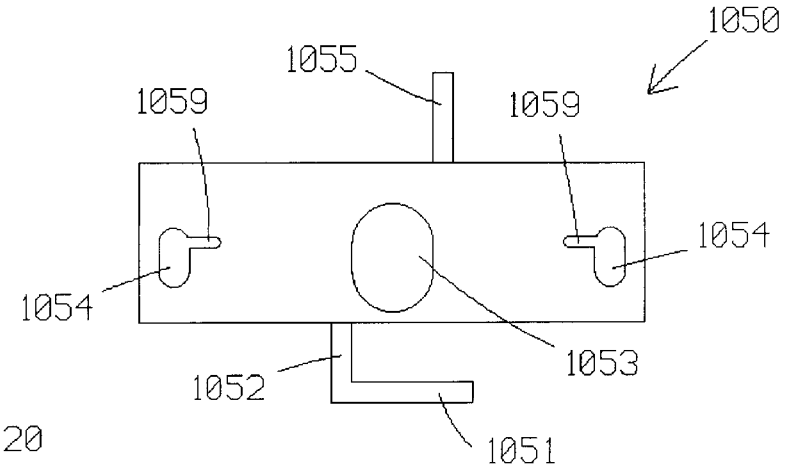
FIG. 20 is a top view of a supplemental weight on the exercise apparatus of FIG. 19.

Supplemental weights 1050 are movably mounted on the guide rods 112*j* and 114*j* above the top plate 123*j*. Also, a safety shield 1001 is provided to substantially cover or enclose the moving parts of the apparatus 1000. A slot 1002 is provided in the shield 101 to facilitate manipulation of the supplemental weights 1050. As shown in FIG. 20, a shaft 1052 is sized and configured to extend through the slot 1002 and connect a respective weight 1050 to a respective handle 1051 disposed on the near side of the shield 1001.

A central hole 1053 is formed through the weight 1050 to provide clearance for the cable 138*j*. Smaller oval holes 1054 are formed through the weight 1050 to accommodate the guide rods 112*j* and 114*j*. Pins (not shown) extend transversely from respective guide rods 112*j* and 114*j* and toward one another. Transverse notches (not shown) are formed in the bottom of the weight 1050 to engage the pins when the weight 1050 occupies a first position relative to the guide rods 112*j* and 114*j*. Transverse slots 1059 are formed through the weight 1050 to accommodate the pins when the weight 1050 occupies a second, transversely displaced position relative to the guide rods 112*j* and 114*j*.

Each weight 1050 is lowered toward the top plate 123*j* by pulling the handle 1051 toward the reader and allowing the weight 1050 to descend. The slot 1002 does not extend all the way down to the lowermost position of the top plate 123*j*. Also, a frame member 1011 spans the rear of the machine 1000 and cooperates with a rearwardly extending pin 1055 on each weight 1050 to further limit downward movement of each weight 1050. As a result, each weight 1050 is movable into the path of the top plate 123*j* but is supported by the top plate 123*j* only after the latter has traveled upward a first distance. After the top plate 123*j* reaches the lower extent of the slot 1002, continued upward movement of the top plate 123*j* encounters additional resistance to the extent that any supplemental weights 1050 are within the path of the top plate 123*j*.

Like on the previously described machine 400, the shield 1001 may be made to cooperate with the shaft 1052 in a manner which controls descent of the weight 1050 but does not interfere with ascent of the weight 1050. Also, the weights 1050 (as well as the weights on other embodiments) may be coated with a shock absorbing material or otherwise modified to reduce impact and/or noise during operation.

Figure 21:
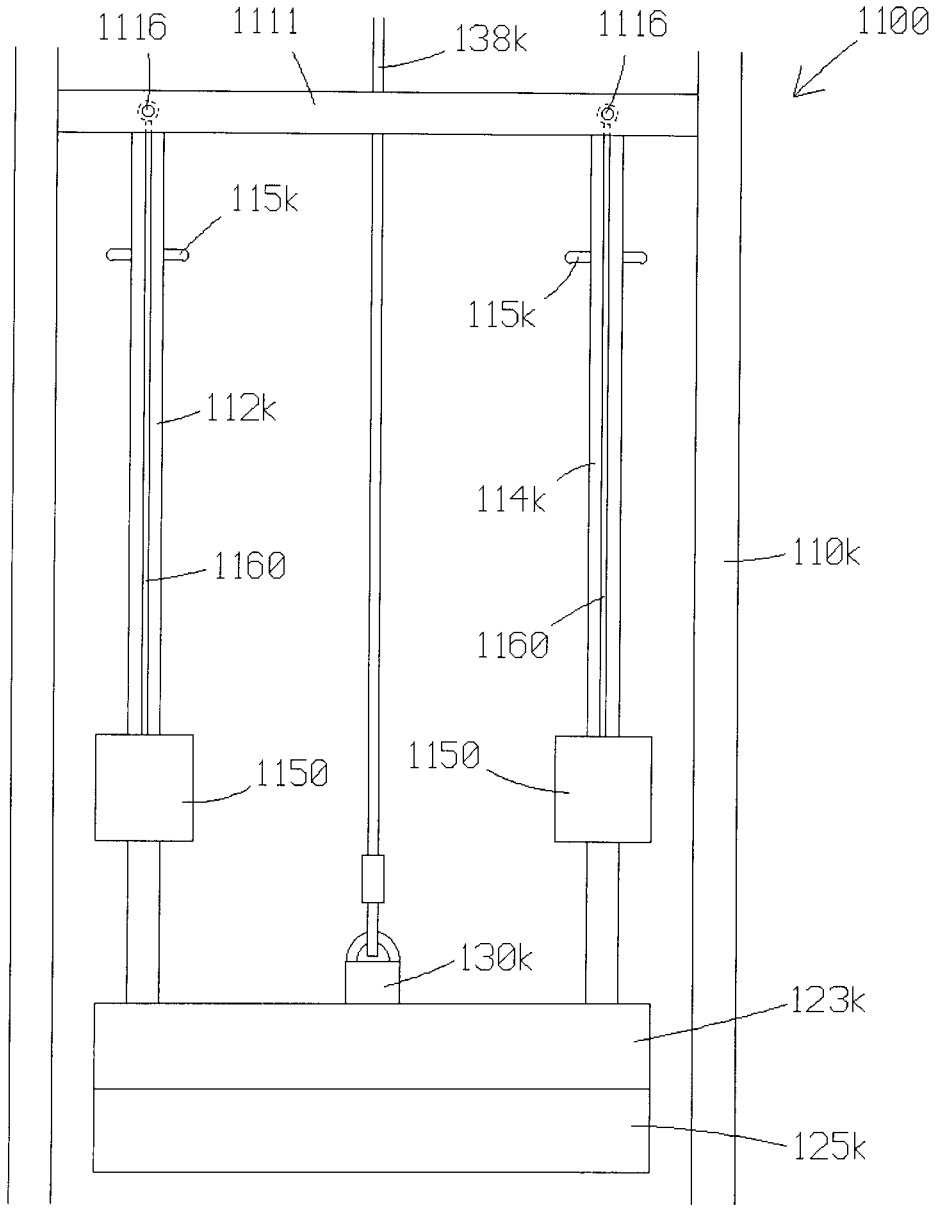
FIG. 21 is a partially fragmented, front view of an eleventh exercise apparatus constructed according to the principles of the present invention.

FIG. 21 shows an eleventh weight stack machine 1100 which has been modified in accordance with the principles of the present invention, and which combines aspects of the foregoing embodiment 1000 and the first embodiment 100. The machine 100 includes a frame 110*k* designed to rest upon a floor surface. First and second guide rods 112*k* and 114*k* extend vertically between lower and upper ends of the frame 110*k*. A top plate 123*k* and underlying weight plates 125*k* are movably mounted on both of the guide rods 112*k* and 114*k*.

A selector rod 130*k* extends through the plates 123*k* and 125*k* and is selectively connected to any desired plate by a selector pin or other means known in the art. A cable 138*k* extends from an upper end of the selector rod 130*k* to one or more force receiving members which operate in a manner known in the art. As a result, movement of a force receiving member is resisted by gravity acting on the selected number of plates.

Supplemental weights 1150 are movably mounted on the guide rods 112*k* and 114*k* above the top plate 123*a*. The weights 1150 configured similar to the weights 150 shown in FIGS. 2–3. A hole is formed through each of the weights 1150 to accommodate one of the guide rods 112*k* or 114*k*. A transverse notch is formed in the bottom of each weight 1150, and a transverse slot, which extends perpendicular to the notch, is formed through each weight 1150.

Each weight 1150 is mounted on a respective guide rod 112*k* or 114*k*. A rigid pin 115*k* is rigidly secured to each guide rod 112*k* and 114*k* and extends radially outward from a respective guide rod 112*k* or 114*k*. When disposed above a respective pin 115*k*, either weight 1150 may be maneuvered relative to a respective guide rod 112*k* or 114*k* so that the groove in the weight 1150 aligns with the pin 115*k* and thereby biases the weight 1150 against movement relative to the guide rod 112*k* or 114*k*. From this position, either weight 1150 may be maneuvered relative to a respective guide rod 112*k* or 114*k* so that the slot in the weight 1150 aligns with the pin 115*k* and thereby provides clearance for the weight 1150 to move downward beneath the pin 115*k* and into the path of the top plate 123*k*.

Contrary to the weights 150 on the first embodiment 100, the weights 1150 are tethered to the frame by flexible strings 1160. A first end of each string 1160 is connected to a respective weight 1150, and a second, opposite end of each string 1160 is connected to a respective bolt 1116 on a frame member 1111. The lengths of the strings 1160 are such that the weights 150 cannot descend all the way down to the lowermost position of the top plate 123*k*. Rather, the top plate 123*k* encounters any "selected" supplemental weights 1150 only after traveling upward a first distance. Those skilled in the art will also recognize that two weights (1150 or 150) with discrete masses provide three discrete resistance increments, including the mass of one weight, the mass of the other weight, and the combined mass of both weights. Those skilled in the art will also recognize that similar weight suspending tether arrangements may be used on other embodiments disclosed herein.

Figure 22:
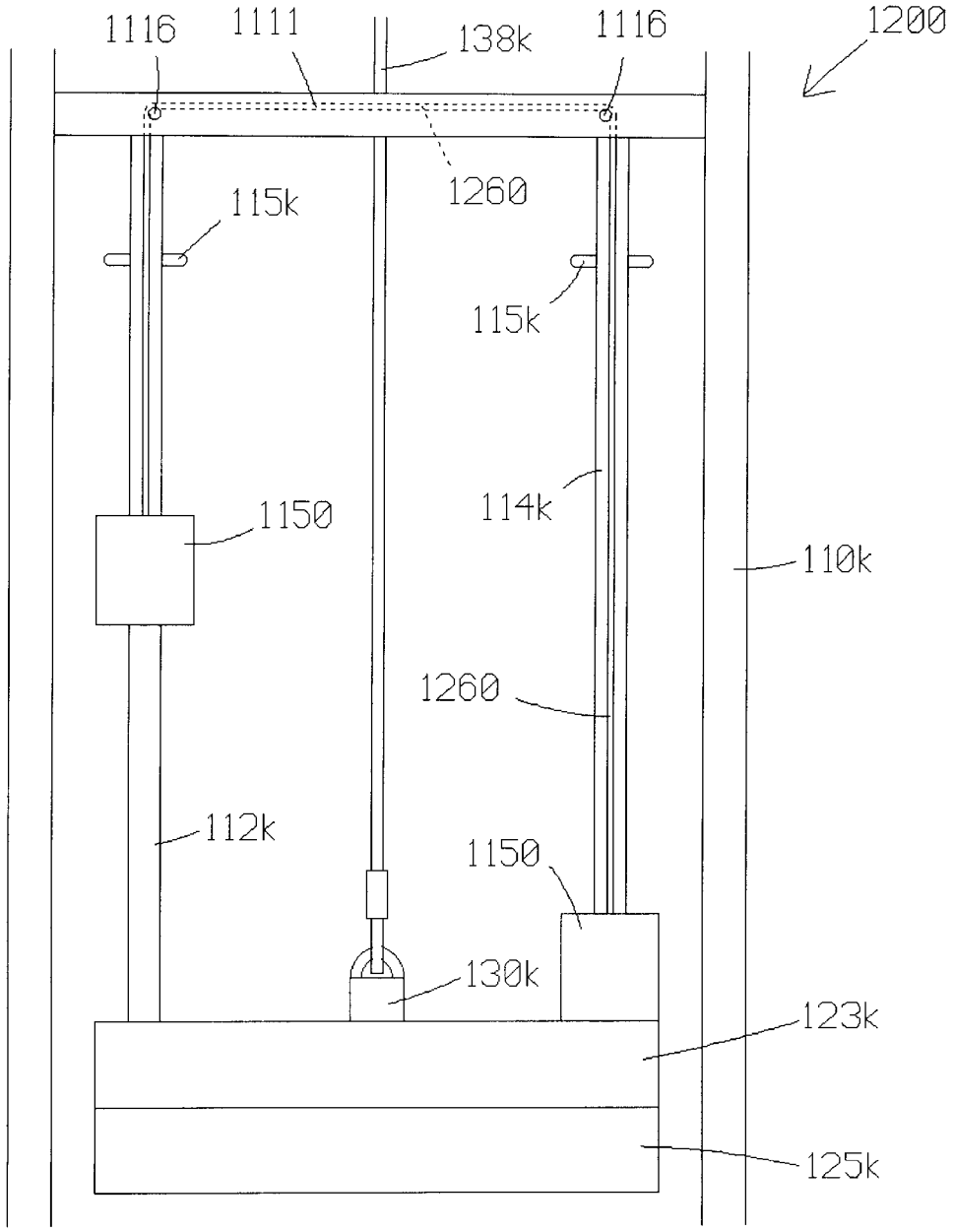
FIG. 22 is a partially fragmented, front view of a twelfth exercise apparatus constructed according to the principles of the present invention.

FIG. 22 shows a twelfth weight stack machine 1200 which has been modified in accordance with the principles of the present invention, and which is similar in many respects to the foregoing embodiment 1100 (as suggested by the common reference numerals). In fact, the only structural distinction regards the manner in which the weights 1150 are tethered. In particular, the twelfth embodiment 1200 has a single flexible line 1260 which extends from a first end, which is connected to one of the weights 1150, to an intermediate portion, which is disposed about the bolts 1116, to a second, opposite end, which is connected to the other weight 1150.

The length of the line 1260 is such that both weights 1150 cannot move to the lowermost position of the top plate 123*k* at the same time. As a result of this arrangement, either weight may be moved to the lowermost position, in which case, the other weight is available for descent only to an intermediate position along the path of the top plate 123*k*. Those skilled in the art will recognize that a coupling must be established between the relatively lower weight 1150 and the top plate 123*k* if the relatively lower weight 1150 weighs less than the other weight 1150. For example, hook and loop fasteners, like those shown in FIG. 17, may be provided on the relatively lower weight 1150 and the top plate 123*k*.

The present invention may also be described in terms of methods. For example, the present invention may be said to provide a method of adjusting weight resistance to exercise. In this regard, a frame is provided with a first guide rod and a second guide rod, and a radially extending, rigid support on each said guide rod. A stack of primary weights is movably mounted on each said guide rod beneath each said support. A secondary weight is movably mounted on only the first guide rod, and a secondary weight movably mounted on only the second guide rod. The secondary weight on the first guide rod is selectively maneuvered out of engagement with the support on the first guide rod and downward onto an uppermost weight in the stack. The secondary weight on the second guide rod is selectively maneuvered out of engagement with the support on the second guide rod and downward onto the uppermost weight in the stack. In this way, a user may selectively add the mass of either said secondary weight or the combined mass of each said secondary weight to the uppermost weight in the stack.

In another such method, a frame is provided with first and second guide rods, each having a support extending radially therefrom proximate an upper end thereof. A stack of primary weights is movably mounted on both of the guide rods beneath each said support. A first supplemental weight is movably mounted on the first of the guide rods. A second supplemental weight is movably mounted on the second of the guide rods. The first supplemental weight is selectively moved from a first location, overlying a respective support, to a second location, beneath the respective support and within a path traversed by an uppermost weight in the stack. The second supplemental weight is selectively moved from a first location, overlying a respective support, to a second location, beneath the respective support and within the path traversed by the uppermost weight in the stack. As a result, the individual mass of either said supplemental weight, as well as the combined mass of each said supplemental weight, is available to be added to the uppermost weight in the stack.

Yet another such method involves providing a frame with a first guide rod, a second guide rod, and at least one rigid support proximate an upper end of each said guide rod. A stack of primary weights is movably mounted on both the first guide rod and the second guide rod beneath each said rigid support. A first supplemental weight is movably mounted on only the first guide rod. A second supplemental weight is movably mounted on only the second guide rod. The first supplemental weight is selectively maneuvered, independent of the second supplemental weight, relative to the first guide rod, out of engagement with the rigid support, and downward toward an uppermost weight in the stack. The second supplemental weight is selectively maneuvered, independent of the first supplemental weight, relative to the second guide rod, out of engagement with the rigid support, and downward toward the uppermost weight in the stack.

In still another method of adjusting weight resistance to exercise, a frame is provided with a first guide rod having a first rigid support which is rigidly secured to the first guide rod and extends radially outward from the first guide rod, and with a second guide rod having a second rigid support which is rigidly secured to the second guide rod and extends radially outward from the second guide rod. A stack of weight plates, including a top plate, is mounted on both the first guide rod and the second guide rod for movement between a lowermost position and an uppermost position beneath both the first rigid support and the second rigid support. A connector is interconnected between a force receiving member and a desired number of plates in the stack. A first supplemental weight is mounted on at least the first guide rod for movement along the first guide rod. A second supplemental weight is mounted on at least the second guide rod for movement along the second guide rod. The first supplemental weight is selectively maneuvered from a first upper position, resting on the first rigid support, to a first lower position, disposed entirely beneath the first rigid support. The second supplemental weight is selectively maneuvered from a second upper position, resting on the second rigid support, to a second lower position, disposed entirely beneath the second rigid support.

In yet another such method, a frame is provided with an interior space bounded by a shield. A stack of weight plates, including a top plate, is movable relative to the frame between a lowermost position and an uppermost position inside the interior space. A connector is interconnected between a force receiving member, disposed outside the interior space, and a desired number of plates in the stack. A supplemental weight is disposed above the stack and movable relative to the frame between a first position and a second position inside the interior space, wherein the first position is above the uppermost position, and the second position is beneath the uppermost position. A handle is connected to the supplemental weight and movable relative to the frame between a first position and a second position outside the interior space. The handle is selectively moved from the first position to the second position outside the interior space in order to move the supplemental weight from the first position to the second position inside the interior space.

The foregoing description and/or the claims set forth below use certain terms which should be construed along the following lines to the extent necessary to overcome any relevant prior art. The lowermost and uppermost positions of the top plate in the weight stack are defined with reference to all parts and/or portions which are rigidly secured thereto. The space defined between these positions is bordered vertically by the positions themselves and horizontally by the planform of the top plate. The substantially fixed path which is said to be traversed by the supplemental weight is limited in length to the height of the machine and includes the lowermost and uppermost positions of the top plate. The substantially closed loop which is said to be formed about the cable and/or one or more guide rods includes any closed curve not having a break or gap greater in width than the part(s) enclosed within the curve.

The foregoing description references specific embodiments and methods but will enable those skilled in the art to recognize additional improvements, combinations, and/or applications. For example, the supplemental weights may be secured to the frame and/or to the top plate by other arrangements which nonetheless incorporate the essence of the present invention. Moreover, one or more features of a particular embodiment may be suitable for use on another embodiment, either alone or in combination with features from still other embodiments. In view of the foregoing, the scope of the present invention is to be limited only to the extent of the following claims.

What is claimed is:

1. A method of adjusting weight resistance to exercise, comprising the steps of:

providing a frame with a first guide rod and a second guide rod, and a radially extending, rigid support on each said guide rod;

providing a stack of primary weights movably mounted on each said guide rod beneath each said support;

providing a secondary weight movably mounted on only the first guide rod;

providing a secondary weight movably mounted on only the second guide rod;

selectively maneuvering the secondary weight on the first guide rod out of engagement with the support on the first guide rod and downward onto an uppermost weight in the stack; and selectively maneuvering the secondary weight on the second guide rod out of engagement with the support on the second guide rod and downward onto the uppermost weight in the stack, whereby a user may selectively add the mass of either said secondary weight or the combined mass of each said secondary weight to the uppermost weight in the stack.

2. The method of claim 1, wherein each said maneuvering step involves lifting a respective secondary weight upward relative to a respective guide rod.

3. The method of claim 2, wherein each said maneuvering step further involves rotating a respective secondary weight relative to a respective guide rod.

4. The method of claim 1, wherein each said maneuvering step involves rotating a respective secondary weight relative to a respective guide rod.

5. A method of adjusting weight resistance to exercise, comprising the steps of:

providing a frame with first and second guide rods, each having a support extending radially therefrom proximate an upper end thereof;

providing a stack of primary weights movably mounted on both of the guide rods beneath each said support;

providing a first supplemental weight movably mounted on the first of the guide rods;

providing a second supplemental weight movably mounted on the second of the guide rods;

selectively moving the first supplemental weight from a first location, overlying a respective support, to a second location, beneath the respective support and within a path traversed by an uppermost weight in the stack; and selectively moving the second supplemental weight from a first location, overlying a respective support, to a second location, beneath the respective support and within the path traversed by the uppermost weight in the stack, whereby the individual mass of either said supplemental weight, as well as the combined mass of each said supplemental weight, is available to be added to the uppermost weight in the stack.

6. The method of claim 5, wherein each said moving step involves lifting a respective supplemental weight upward relative to a respective one of the guide rods.

7. The method of claim 6, wherein each said disengaging step further involves rotating a respective supplemental weight relative to a respective one of the guide rods.

8. The method of claim 5, wherein each said disengaging step involves rotating a respective supplemental weight relative to a respective one of the guide rods.

9. A method of adjusting weight resistance to exercise, comprising the steps of:

providing a frame with a first guide rod and a first stationary support proximate an upper end of the first guide rod, and a second guide rod and a second stationary support proximate an upper end of the second guide rod;

providing a stack of primary weights movably mounted on both the first guide rod and the second guide rod beneath each said stationary support;

providing a first supplemental weight movably mounted on only the first guide rod and adapted to be selectively supported by the first stationary support;

providing a second supplemental weight movably mounted on only the second guide rod and adapted to be selectively supported by the second stationary support;

selectively maneuvering only the first supplemental weight relative to the first guide rod and the first stationary support to release the first supplemental weight from the first stationary support for movement downward toward an uppermost weight in the stack; and selectively maneuvering only the second supplemental weight relative to the second guide rod and the second stationary support to release the second supplemental weight from the second stationary support for movement downward toward the uppermost weight in the stack.

10. The method of claim 9, wherein the frame is provided with each said stationary support projecting radially outward from a respective guide rod.

11. The method of claim 10, wherein each said supplemental weight is provided with a keyway sized and configured to bypass a respective stationary support.

12. The method of claim 11, wherein each said supplemental weight is selectively maneuvered relative to a respective guide rod and a respective stationary support until the keyway aligns with the respective stationary support.

13. The method of claim 12, wherein the keyway is rotatable into and out of alignment with the respective stationary support.

14. The method of claim 9, wherein each said supplemental weight is provided with a keyway sized and configured to bypass a respective stationary support.

15. The method of claim 14, wherein each said supplemental weight is selectively maneuvered relative to a respective guide rod and a respective stationary support until the keyway aligns with the respective stationary support.

16. The method of claim 15, wherein the keyway is rotatable into and out of alignment with the respective stationary support.

17. The method of claim 9, further comprising the step of interconnecting a tether between the first supplemental weight and the frame.

18. The method of claim 17, further comprising the step of interconnecting a tether between the second supplemental weight and the frame.

19. The method of claim 9, further comprising the step of interconnecting a tether between the first supplemental weight and the second supplemental weight.

20. The method of claim 9, further comprising the step of providing a third supplemental weight movably mounted on only the first guide rod, above the first supplemental weight, and adapted to be selectively supported by the first stationary support.

* * * * *